US010326216B2

(12) United States Patent
Lybrand

(10) Patent No.: US 10,326,216 B2
(45) Date of Patent: Jun. 18, 2019

(54) WIRE-TO-WIRE CONNECTOR WITH SHUNT

(71) Applicant: AVX Corporation, Fountain Inn, SC (US)

(72) Inventor: Brent Lybrand, Fountain Inn, SC (US)

(73) Assignee: AVX CORPORATION, Fountain Inn, SC (US)

( * ) Notice: Subject to any disclaimer, the term of this patent is extended or adjusted under 35 U.S.C. 154(b) by 0 days.

(21) Appl. No.: 16/051,905

(22) Filed: Aug. 1, 2018

(65) Prior Publication Data

US 2019/0044254 A1 Feb. 7, 2019

Related U.S. Application Data

(60) Provisional application No. 62/540,119, filed on Aug. 2, 2017, provisional application No. 62/695,551, filed on Jul. 9, 2018.

(51) Int. Cl.

| | |
|---|---|
| ***H01R 11/20*** | (2006.01) |
| ***H01R 4/2433*** | (2018.01) |
| ***H01R 13/11*** | (2006.01) |
| ***H01R 13/193*** | (2006.01) |
| ***H01R 4/2404*** | (2018.01) |
| ***H01R 13/58*** | (2006.01) |
| ***H01R 4/70*** | (2006.01) |
| ***H01R 13/627*** | (2006.01) |

(52) U.S. Cl.

CPC ..... *H01R 4/2433* (2013.01); *H01R 4/2404* (2013.01); *H01R 4/70* (2013.01); *H01R 13/11* (2013.01); *H01R 13/193* (2013.01); *H01R 13/58* (2013.01); *H01R 13/6271* (2013.01)

(58) Field of Classification Search

CPC ... H01R 4/2429; H01R 4/2433; H01R 9/0757
USPC ..... 439/395, 402, 405, 404, 403, 418, 417
See application file for complete search history.

(56) References Cited

U.S. PATENT DOCUMENTS

| | | | | |
|---|---|---|---|---|
| 6,135,804 | A * | 10/2000 | Lux | H01R 4/2433 439/397 |
| 6,152,786 | A * | 11/2000 | Perrin | H01R 4/5083 439/417 |
| 6,648,671 | B2 * | 11/2003 | Suzuki | H01R 4/245 439/404 |
| 9,287,673 | B2 * | 3/2016 | Galla | H01R 43/01 |
| 2008/0076295 | A1 | 3/2008 | Lappoehn | |

(Continued)

OTHER PUBLICATIONS

International Search Report and Written Opinion in PCT/US2018/044757 dated Nov. 16, 2018 (10 pages).

*Primary Examiner* — Phuong Chi T Nguyen
(74) *Attorney, Agent, or Firm* — Foley & Lardner LLP

(57) ABSTRACT

This disclosure provides a method and apparatus for connecting and disconnecting a first wire to a second wire. More specifically, an apparatus that includes a first electrical contact, a second electrical contact, an insulated housing, and a male contact prong (i.e., a shunt) is disclosed. In an embodiment, the first and second electrical contacts conductively connect with a first and second wire, respectively, via an insulation displacement connector. Furthermore, the male contact prong conductively connects (i.e., shunts) the first and second electrical contacts together. A wire-to-wire contact with shunt allows for two wires to be quickly and efficiently connected and disconnected.

20 Claims, 20 Drawing Sheets

(56) References Cited

U.S. PATENT DOCUMENTS

| | | | |
|---|---|---|---|
| 2010/0107407 | A1 | 5/2010 | Freakes |
| 2011/0256754 | A1 | 10/2011 | Bishop |
| 2012/0003850 | A1 | 1/2012 | Bishop et al. |
| 2013/0130538 | A1 | 5/2013 | La Salvia |

* cited by examiner 600
620
610
608
630

600
620
672
605
609
610
625
677
680
675
608
621
630

600
650
670
696
699
609
695
630
610
620
697
698
694
681
631

WIRE-TO-WIRE CONNECTOR WITH SHUNT

CROSS-REFERENCE TO RELATED APPLICATIONS

The present application claims priority to U.S. Provisional Application No. 62/540,119, filed Aug. 2, 2017, and further claims priority to U.S. Provisional Application No. 62/695,551, filed Jul. 9, 2018, each of which are incorporated by reference in their respective entireties.

FIELD

The present application relates generally to the field of electrical connectors, and more particularly to a type of connector used to connect an insulated wire to another insulated wire.

BACKGROUND

The following description is provided to assist the understanding of the reader. None of the information provided or references cited are admitted to be prior art.

Various types of connectors are used for forming connections between an insulated wire and any manner of electronic or electrical component. These connectors are typically available as sockets, plugs, and shrouded headers in a vast range of sizes, pitches, and plating options. Traditionally, for two wires to be connected together, a user must strip the first and second wires, twist the two ends together, and then secure them to one other. This process can be tedious, inefficient, and undesirable. Furthermore, a wire-to-wire connection that may fall apart or short out unexpectedly could be hazardous or even deadly, especially in dangerous applications (e.g., the use of explosives in a mining operation). Thus, a quick, efficient, and reliable means of connecting and disconnecting wires is needed.

SUMMARY

The systems, methods and devices of this disclosure each have several innovative aspects, no single one of which is solely responsible for the desirable attributes disclosed herein.

A wire-to-wire connector includes a first electrical contact, a second electrical contact, and an insulated housing. The first electrical contact includes a first insulation displacement connector portion and a first shunt connector portion. The second electrical contact includes a second insulation displacement connector portion and a second shunt connector portion. The insulated housing includes a first electrical contact inlet, a second electrical contact inlet, a shunt opening, a first wire opening, and a second wire opening. The first and second electrical contact inlets are designed and shaped to ensure that they can receive the first and second electrical contacts, respectively. In an embodiment, the first and second electrical contacts have a depth great enough to ensure that the top of electrical contacts are flush with the insulated housing when they are completely compressed into the inlet. Further, the openings of the first and second electrical contact inlets are on a first side of the insulated housing, while the shunt opening is located on a second side of the insulated housing (i.e., the openings are on opposite sides of the housing). Additionally, the first and second electrical contacts may include juts that bite into the insulated housing and create a frictional force between the electrical contact and the insulated housing. In an embodiment, the insulated housing may have molded recesses corresponding to each jut position that the juts may sit in when received by the insulated housing.

The wire-to-wire connector also includes an electrical shunt that has a male contact prong. The male contact prong is designed to enter into the shunt opening of the insulated housing and to mechanically and electrically connect to the shunt connector portion of any electrical contact that is housed in the insulated housing. In an embodiment, the shunt connector portion of the first and second electrical contacts include a female contact socket that is designed to form and maintain an electrically-conductive connection to the male contact prong. The female contact socket of the first and second electrical contacts may be made up of two contact tines that each have a knob at their distal end that extends towards the other contact tine. The distance between the two contact tines is less than the thickness of the male contact tine. This ensures that the two contact tines compress the male contact prong and create a mechanical and electrical connection between the electrical contact and the male contact prong. Furthermore, the distal end of the male contact prong includes a tapered edge. The tapered edge ensures that male contact prong can be readily received between the two contact tines of the female contact socket.

Further, the insulated housing also includes a latching portion. In an embodiment, the latching portion includes two rails spaced a distance apart and a tapered locking edge on two opposite sides of the insulated housing. The latching portion may be symmetrical about any vertical or horizontal centerline plane that extends through the center point of the insulated housing. Additionally, the electrical shunt may include a latching means that is configured to secure the insulated housing to the electrical shunt. In an embodiment, the latching means is two latching prongs that extend in a substantially parallel direction with the male contact prong away from the electrical shunt molding. Each of the two latching prongs may include a knob at the distal end of each latching prong that extends towards a vertical centerline of the electrical shunt. The two latching prongs are spaced a distance apart such that they can compress the insulated housing and the knobs rest on the tapered locking edge when the electrical shunt is fully engaged with the insulated housing. The male contact prong is centered on and extends along the vertical centerline. The male contact prong extends along a shunt plane from the shunt molding to the male contact prong's furthest extent (i.e., the distal end with the tapered edge). In other words, the shunt plane that the male contact prong extends is defined by the vertical centerline and the wider side of the male contact prong. The latching prongs are centered on the shunt plane that the male contact prong extends along.

Moreover, the first and second wire openings of the insulated housing extend entirely through the insulated housing. That is, a wire could enter one side of the insulated housing and protrude from the other side of the insulated housing. The insulated housing also ensures that the opening of the female contact socket of the first electrical contact is aligned with the opening of the female contact socket of the second electrical contact when they are both fully received in their respective contact inlets of the insulated housing. Furthermore, the first contact inlet extends into the insulated housing along a first plane, the second contact inlet extends into the housing along a second plane, and the shunt opening extends into the insulated housing in a third plane. The first and second planes are parallel to one another, and the third plane is perpendicular to the first and second planes. That is, the planes that are created by the depths and longest edges of the first and second contact inlets are parallel, and the plane that is created by the depth and longest edge of the shunt opening is perpendicular to the planes of the first and second contact inlets.

The insulation displacement connector portion of the first and second electrical contacts includes a first blade, a second blade, and a third blade that extend from a base. The first, second, and third blades extend from the base to each blades furthest extent on along a contact plane. Furthermore, the first, second, and third blades extend from the base to each blades furthest extent along the same contact plane on which the contact tines of the female contact socket extend from the base to the contact tines furthest extent. In an embodiment, the first, second, and third blades are all tapered at a distal end of each blade. The first blade may be straight on one edge and tapered on the opposite side at a distal end, the second blade may have a taper on both sides of a distal end, and the third blade may be tapered on one edge and straight on the opposite side of a distal end. Further, the first blade and the second blade may create a first insulation displacement connector and the second blade and the third blade may create a second insulation displacement connector. The tapers at the distal ends of the first, second, and third blades provide a means for guiding a corresponding wire towards a stripping portion. The width of the stripping portion is preferably less than or equal to the width of a core of the corresponding wire. Additionally, the stripping portion have a width that is consistent its entire length. In other words, the distance between the first blade and second blade is consistent (i.e., the stripping portion) until the taper of the second or first blade begins, and the distance between the second blade and the third blade is consistent until the taper of the second or third blade begins. In one embodiment, the stripping portion has sharp edges on either side. In alternative embodiments, the stripping portion has any design that will allow it to displace insulation and make an electrical connection between the wire and the electrical contact. The first, second and third blades are all space a distance apart that allows for the stripping portion to displace insulation of a corresponding wire and create an electrical connection between the wire and the electrical contact. Further, the insulation displacing connector portion opens in the same direction as the shunt connector portion opens. In other words, the female contact socket opens (i.e., receives a corresponding device) in the same direction that the insulation displacement connectors do.

A wire-to-wire connector may be used to electrically couple two or more wires together. For example, a first wire is inserted into a first wire opening of an insulated housing. Then a first electrical contact is compressed into a first electrical contact inlet. The compression causes the first electrical contact to displace insulation on the first wire and results in an electrical contact between the first electrical contact and the first wire. In an embodiment, a first shunt connector portion of the first electrical contact is not connected to anything. In an alternative embodiment, the first shunt connector portion may be electrically and mechanically coupled to a male contact prong. Further, a second wire is inserted into a second wire opening of an insulated housing. Then a second electrical contact is compressed into a second electrical contact inlet. The compression of the second electrical contact causes the second electrical contact to displace insulation on the second wire and results in an electrical connection between the first electrical contact and the first wire. In an embodiment, a second shunt connector portion of the second electrical contact is not connected to anything. In an alternative embodiment, the compression of the first electrical contact may also result in the first shunt connector portion being electrically and mechanically coupled to a male contact prong. In another embodiment, a male contact prong can be inserted into a shunt opening of the insulated housing such that the male contact prong engages the first shunt connector portion of the first electrical connector and the second shunt connector portion of the second electrical connector to conductively couple the first electrical contact to the second electrical contact. In alternative embodiment, the male contact prong can be removed from the shunt opening of the insulated housing such that the male contact prong disengages the first shunt connector portion of the first electrical connector and the second shunt connector portion of the second electrical connector to conductively decouple the first electrical contact from the second electrical contact.

Another connector is disclosed that includes an insulated housing that includes a shunt portion comprising an electrically-conductive contact portion configured to selectively engage one or more electrical contacts and a cap portion comprising an insulated insert portion configured to selectively engage the one or more electrical contacts in place of the electrically-conductive contact portion. In an implementation, the electrically-conductive contact portion may comprise two or more male contact prongs and two or more latching prongs, wherein the two or more male contact prongs are electrically connected. In an implementation, the insulated insert portion comprises two or more insulated male tines. The two male contact prongs may be spaced a distance apart equal to a second distance between the two insulated male tines. In an implementation, the connector further includes a break-away portion connecting the shunt portion to the cap portion.

Still another connector is closed that includes an insulated housing comprising a first electrical contact and a male-contact-receptacle portion exposing a portion of the first electrical contact. The connector further includes an electrical shunt comprising a shunt portion having an electrically-conductive contact portion configured to selectively electrically and mechanically engage the first electrical contact through the male-contact-receptacle portion, and a cap portion comprising an insulated male insert configured to selectively mechanically engage the first electrical contact. The electrically-conductive contact portion may comprise two or more male contact prongs and two or more latching prongs, and the insulated male insert may comprise two or more insulated male tines. In an implementation, the electrically-conductive contact portion further comprises at least one shunt cap sealing pin. The insulated housing may further comprise a latching receptacle portion comprising at least one shunt cap sealing pin receptacle and two or more latching prong receptacles. In addition, the at least one shunt cap sealing pin receptacle may have a matching geometry to the at least one shunt cap sealing pin, and/or the two or more latching prongs may be configured to latch with two or more latching prong receptacles.

In an implementation, the male-contact-receptacle portion comprises two male contact prong receptacles spaced a distance apart equal to a second distance between the two male contact prongs and equal to a third distance between the two insulated male tines. Each of the two male contact prong receptacles may be configured to allow for one of the two male contact prongs to electrically and mechanically connect to the first electrical contact. In addition, a thickness of each of the two male contact prongs may be greater than a distance between two contact tines of the first electrical contact. Each of the male contact prong receptacles may be configured to allow for a respective one of the two insulated male tines to mechanically connect to a corresponding electrical contact. Also, each of the two male contact prong receptacles may be configured to allow for a respective one of the two insulated male tines to mechanically connect to a corresponding electrical contact.

A method of disconnecting a first and a second wire is also disclosed. The method includes removing an electrical shunt from an insulated housing, wherein the removing the electrical shunt removes an electrically-conductive contact portion of the electrical shunt from a male-contact-receptacle portion of the insulated housing; and inserting an insulated male insert portion of a cap portion of the electrical shunt into the male-contact-receptacle portion of the insulated housing. The method may further include removing the cap portion from the electrically-conductive contact portion. Removing the electrical shunt from the insulated housing electrically disconnects a first electrical contact from a second electrical contact, and the first electrical contact is electrically and mechanically connected to the first wire and the second electrical contact is electrically and mechanically connected to the second wire. The method may further include inserting a sealing portion of the cap portion into a sealing pin receptacle portion of the insulated housing to seal the electrical contacts within the insulated housing.

The wire-two-wire connector is not limited by its wire contact portion or other components. Particular embodiments of insulation displacement connectors are described in greater detail below by reference to the examples illustrated in the various drawings.

DETAILED DESCRIPTION

Figure 1B:
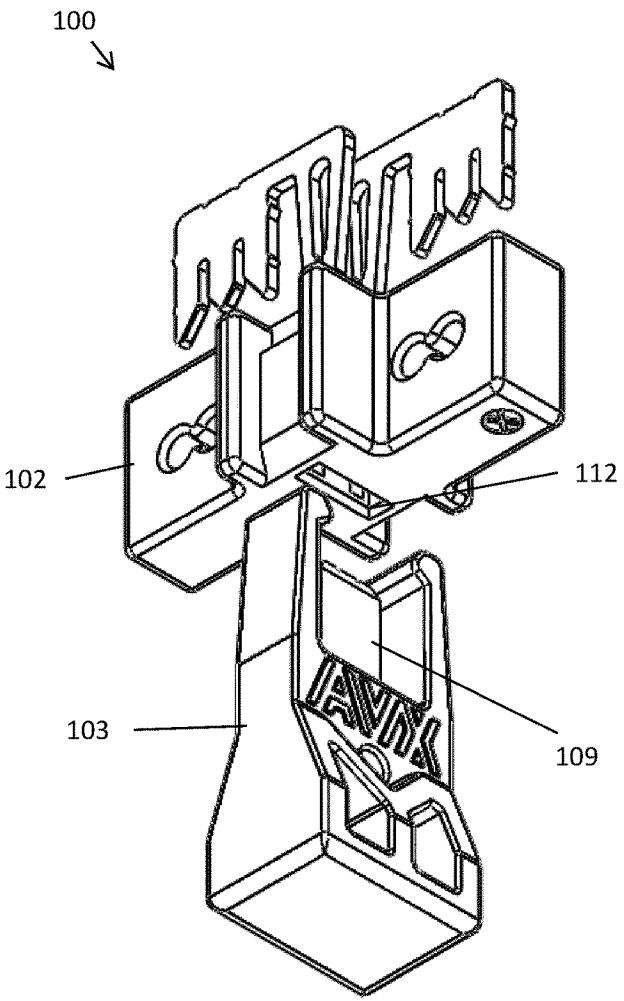
FIG. 1*b* depicts a second isometric view of a wire-to-wire connector accordance with an illustrative embodiment.

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is a wire-to-wire connector that includes at least two electrical contacts, an insulated housing, and a shunt. Such a wire-to-wire connector may be used to efficiently and reliably mechanically and electrically couple one or more wires to each other. Specifically, the connector allows for an efficient and rapid creation of an electrical and mechanical connection between the conductive element of an insulated wire and an electrical contact of the connector. Further, the insulated housing assists in the electrical and mechanical connection between the electrical contact and the insulated wire, and ensures that the electrical contact is secured in an electrically insulated location. Additionally, the shunt allows for a selective electrical connection or disconnection between two or more electrical connectors (and thereby two or more electrical wires). The unique design of the wire-to-wire connector disclosed herein ensures that two or more wires can be efficiently, safely, and reliably connected to and disconnected from live electrical components with minimal human intervention. Furthermore, the wire-to-wire connector allows for more than two wires to be electrically connected to each other, which is beneficial in a system that requires many components to be coupled to a control device or wire. For example, in an example embodiment, the wire-to-wire connector discussed herein allows for delicate instrumentation or other devices to be efficiently networked together and safely and reliably controlled.

In another implementation, the electrical shunt includes a shunt-portion and a cap portion. Such a wire-to-wire connector may be used to efficiently and reliably mechanically and electrically couple one or more electrical components (e.g., insulated wires, contacts, etc.) to each other. Specifically, the wire-to-wire connector allows for an efficient and rapid creation of an electrical and mechanical connection between the conductive element of an insulated wire and an electrical contact of the connector. Further, the insulated housing assists in the electrical and mechanical connection between the electrical contact and the insulated wire, and ensures that the electrical contact is secured in an electrically insulated location.

Additionally, the electrical shunt allows for a selective electrical connection or disconnection between two or more electrical connectors (and thereby two or more electrical wires or other components). The unique design of the wire-to-wire connector disclosed herein ensures that two or more wires can be efficiently, safely, and reliably connected to and disconnected from live electrical components with minimal human intervention. Specifically, the unique design of the shunt portion of the electrical shunt allows for a rapid, safe, and reliable electrical connection between the first electrical contact and the second electrical contact.

Furthermore, the cap portion of the electrical shunt is designed to prevent any inadvertent shorting between internal electrical components when the cap portion is engaged with the insulated housing. In other words, in an example embodiment, the cap portion is designed to seal the first and second electrical contacts within the insulated housing when the cap portion is inserted into or otherwise connected to the insulated housing. Sealing electrical contacts within the insulated housing ensures that no water or other conductive material can contact the electrical contacts and reduces the possibility of a short-circuit or other voltage break-down between the first and second electrical contacts. In an example embodiment, the wire-to-wire connector discussed herein allows for delicate instrumentation or other devices to be efficiently networked together and safely and reliably controlled in any environment.

Various embodiments of a wire-to-wire connector with shunt are illustrated throughout FIGS. 1 through 14. The wire-to-wire connector disclosed in these figures is configured to connect a conductive core of an insulated wire with an electrical contact that may be mechanically and electrically shunted to a second electrical contact. In an embodiment, the electrical contacts may each connect to one, two, three, or more wires. Furthermore, the insulated housing may house one, two, or more electrical contacts. It should be appreciated that the wire-to-wire connectors disclosed herein are not limited by a maximum number of wire positions, electrical contacts, shunts, or types of connections that couple each component together.

Figure 1A:
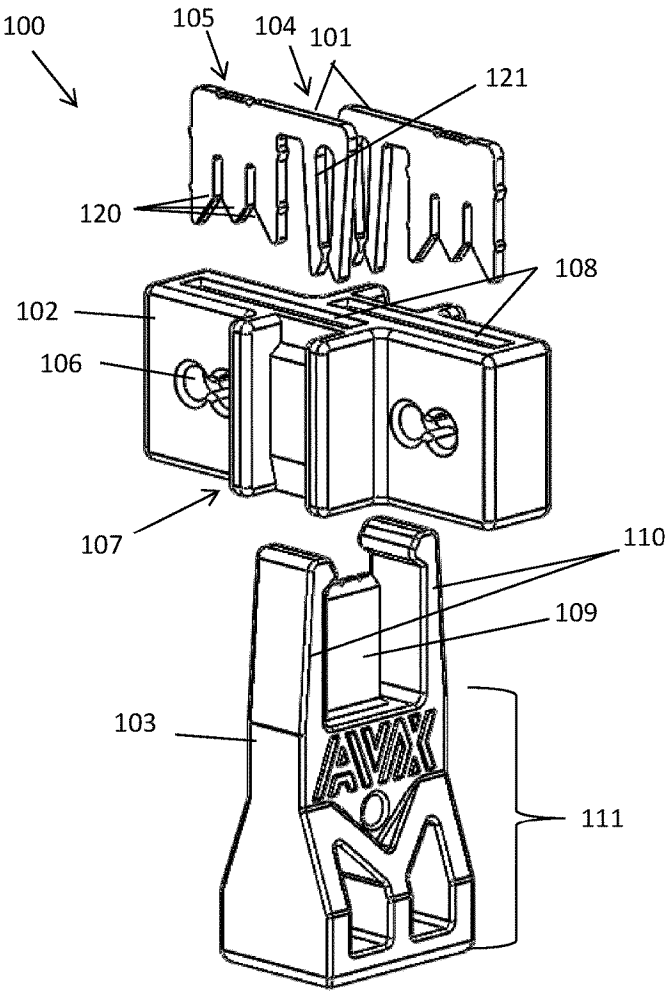
FIG. 1*a* depicts an isometric view of a wire-to-wire connector in accordance with an illustrative embodiment.

Referring to FIGS. 1*a* and 1*b* in general, a wire-to-wire connector 100 with shunt is depicted as four separable elements in accordance with various illustrative embodiments. FIG. 1*a* depicts an isometric view of a wire-to-wire connector 100 in accordance with an illustrative embodiment. FIG. 1*b* depicts a second isometric view of a wire-to-wire connector 100 accordance with an illustrative embodiment. As generally depicted in FIGS. 1*a* and 1*b*, the wire-to-wire connector 100 includes two electrical contacts 101, an insulated housing 102, and an electrical shunt 103. Each of the two electrical contacts 101 includes a shunt connector portion 104 and an insulation displacement connector portion 105. The shunt connector portion 104 includes a female contact socket 121 and the insulation displacement connector portion 105 includes three insulation displacement blades 120. In an embodiment, the insulation displacement connector portion 105 may include two, three, four, or more insulation displacement blades 120 such that insulation displacement connector portion 105 is able to form electrical connections with one, two, or more wires.

Referring generally to FIG. 1*a*, the insulated housing 102 includes wire openings 106, a latching portion 107, and electrical contact inlets 108 sized and shaped to receive the electrical contacts 101. In other words, the two electrical contacts 101 may be inserted and secured into respective electrical contact inlets 108 of the insulated housing 102. In an embodiment, wires are inserted into the wire openings 106 of the insulated housing 102 prior to insertion of the electrical contacts 101 into their respective electrical contact inlet 108. In an alternative embodiment, wires are inserted into the wire openings 106 of the insulated housing 102 when the electrical contacts 101 are partially inserted into their respective electrical contact inlet 108. Upon fully seating the electrical contacts 101 within the respective electrical contact inlets 108, the insulation displacement connector portions 106 of the electrical contacts will displace the insulation of the inserted wires and form an electrical connection therewith.

The electrical shunt 103 includes a male contact prong 109, latching prongs 110, and shunt molding 111. Referring generally to FIG. 1*b*, the insulated housing 101 also includes a shunt opening 112 that is shaped and sized to receive the male contact prong 109. The electrical shunt 103 may be engaged with the insulated housing 102 by inserting the male contact prong 109 into the shunt opening 112. When the entire system is assembled (i.e., the electrical contacts 101 and the electrical shunt 103 are inserted into the insulated housing 102), the male contact prong 109 mechanically and electrically couples with the shunt connector portions 104 of the two electrical contacts 101 and electrically shunts (i.e., electrically connects) the two electrical contacts 101 together. Additionally, the latching prongs 110 of the electrical shunt 103 engage with the latching portion 107 of the insulated housing 102 to mechanically secure the insulated housing 102 to the electrical shunt 103. The shunt molding 111 may be designed to have different sizes depending upon the specific desired application of the wire-to-wire electrical connector 100.

Figure 2:
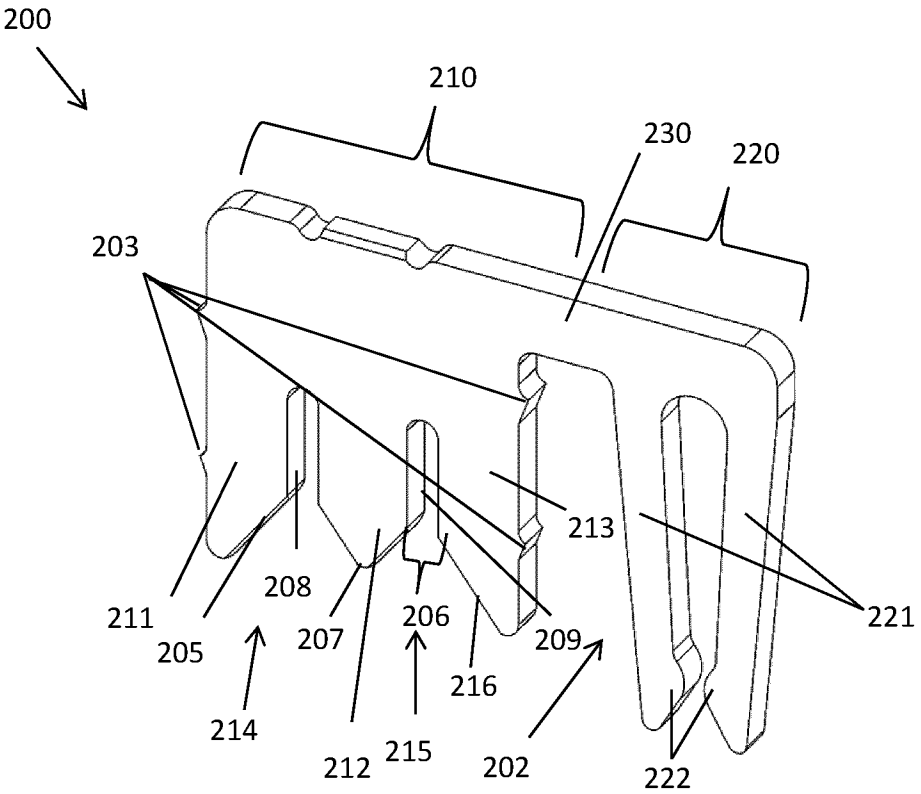
FIG. 2 depicts an isometric view of an electrical contact in accordance with an illustrative embodiment.

FIG. 2 depicts an isometric view of an electrical contact 200 in accordance with an illustrative embodiment. The electrical contact 200 includes an insulation displacement connector portion 210 and a shunt connector portion 220. The insulation displacement connector portion 210 includes a first blade 211, a second blade 212, a third blade 213, and juts 203. Blades 211, 212, and 213 extend from a base 230 in a downward direction. The first blade 211 and the second blade 212 form a first insulation displacement connector 214, and the second blade 212 and the third blade 213 form a second insulation displacement connector 215. The insulation displacement connectors 214 and 215 open downwardly from the insulation displacement connector portion 210. The first blade 211 and the second blade 212 are shaped such that a wire can be guided toward a stripping portion 208 of the second insulation displacement connector 214. In other words, the first blade 211 is straight on one side (i.e., the side not facing the second blade 212) with a tapered edge 205 at the distal end of the first blade 211 and the second blade 212 is tapered on both sides at the distal end of the second blade 212 (i.e., the second blade 212 comes to a point 207 at the distal end). Furthermore, the second blade 212 and the third blade 213 are shaped such that a wire can be guided toward a stripping portion 209 of the second insulation displacement connector 215. That is, the second blade 211 comes to a point at a distal end of the second blade 211 (i.e., has a taper at the distal end) and the third blade 213 is straight on one side (i.e., the side not facing the second blade 212) with a tapered edge 216 at the distal end of the third blade 212. In an embodiment, the tapered edges 205, 207, and 216 are straight edges that extend from a distal end of the respective blades at a consistent angle. In alternative embodiments, the tapered edges 205, 207, and 216 may be of any shape that will guide a wire toward a respective stripping portion.

The stripping portions 208 and 209 displace the insulation of a corresponding wire in order for the electrical contact 200 to create a mechanical and electrical connection to the wire. A width 206 between the second and third blades 212 and 213 at the stripping portion 209 of the second insulation displacement connector 215 is consistent throughout the length of the stripping portions 208 and 209. The width 206 is preferably equal to or slightly lesser than a core of a corresponding wire. That is, the size of the width 206 will be different depending upon the gauge of the wire being used. Similarly, the distance between the first and second blades 211 and 212 at the stripping portion 208 of the first insulation displacement connector 214 is consistent throughout the stripping portion 208 and will vary depending upon application. In alternative embodiments, the stripping portions 208 and 209 may have any design that allows for the insulation displacement connectors 214 and 215 to displace the insulation of a wire and an electrical and mechanical connection to be created between the electrical contact 200 and the core of the wire.

The shunt connector portion 220 of the electrical contact 200 includes a female contact socket 202. The female contact socket 202 includes two contact tines 221 that extend from the base 230 in a downward direction. Similar to the insulation displacement connectors 214 and 215, the female contact socket 202 also opens downwardly. The contact tines 221 extend from the base 230 to their furthest extent along a contact plane. Similarly, the first, second, and third blades 211, 212, and 213 extend from the base 230 to their respective furthest extents along the same contact plane. That is, the first, second, and third blades 211, 212, and 213 extend in the same direction and along the same plane in which the two contact tines 221 extend from the base 230.

The contact tines 221 of the female contact socket 202 may be angled inward toward each other such that the distance between the two contact tines 221 decreases as they extend downward from the base 230 of the shunt contact portion 220. Additionally, the contact tines 221 may each have a knob 222 at the distal end of the contact tine that extends toward the other contact tine. The knobs 222 may be half-circular, rectangular, triangular, or any other polygonal shape. The distance between the contact tines 221 is preferably less than a thickness of a compatible electrical shunt. This will ensure that, when an electrical shunt is positioned between the contact tines 221, the contact tines 221 will compress the electrical shunt and create a reliable mechanical and electrical connection therebetween.

In alternative embodiments, the female contact socket 202 may include more or less than two contact tines. For example, the female contact socket 202 may be a singular socket-shaped tine, or it may include three, four, or more contact tines. Preferably, the female contact socket 202 is adapted such that it can receive and secure a prong from an electrical shunt to create an electrical connection. The contact tines 221 may also have different shapes. For example, the contact tines 221 may be tapered such that the width of the tine is larger at the top and decreases as the contact tines 121 extend downward (i.e., outward from the base 230). In an embodiment, the distance that the contact tines 221 extend away from the base 230 is greater than the distance that the first, second or third blades 211, 212, and 213 extend from the base 230. In an embodiment, the contact tines 221 may extend along the same plane and direction of the first, second, and third blades 211, 212, and 213. Alternatively, the contact tines 211 may extend along the same plane but in an opposite (e.g., one hundred and eighty degree) direction than the first, second, and third blades 211, 212, and 213 extend. The length of the contact tines 221 may be any length that allows for the female contact socket 202 to engage with a corresponding electrical shunt.

As depicted in FIG. 2, the electrical contact 200 contains rectangular-shaped juts 203 that extend outwardly from the insulation displacement connector portion 210. The juts 203 may be seated within a recess of the insulated housing and mechanically secure the electrical contact to the insulated housing. The juts 203 cause friction between the electrical contact 200 and the inside of the insulated housing, thereby restraining the electrical contact 200 within the insulated housing. In alternative embodiments, the juts 203 may be of any shape that allows for the electrical contact 200 to be pressed into a housing and secured. That is, the juts 203 may be shaped as half-circles, squares, or any other polygonal shape. Additionally, the number of juts 203 may be any number that reliably secures the electrical contact 200 within an insulated housing. Further, the juts 203 may be positioned on the insulation displacement connector portion 210, the shunt connector portion 220, the first blade 211, the third blade 213, and/or the female contact socket 202.

In an embodiment, the electrical contact 200 is formed of a single electrically-conductive element. The single electrically-conductive element may be any suitable electrically-conductive material having a gauge and other physical characteristics suitable for maintaining the shape of the electrical contact 200 in the mounting process, as well as in the operating environment of the electrical component to which the electrical contact 200 is mounted. However, it will be appreciated that the electrical contact 200 may also be formed of multiple conductive elements that are welded, soldered, or otherwise electrically and mechanically connected.

Figure 3B:
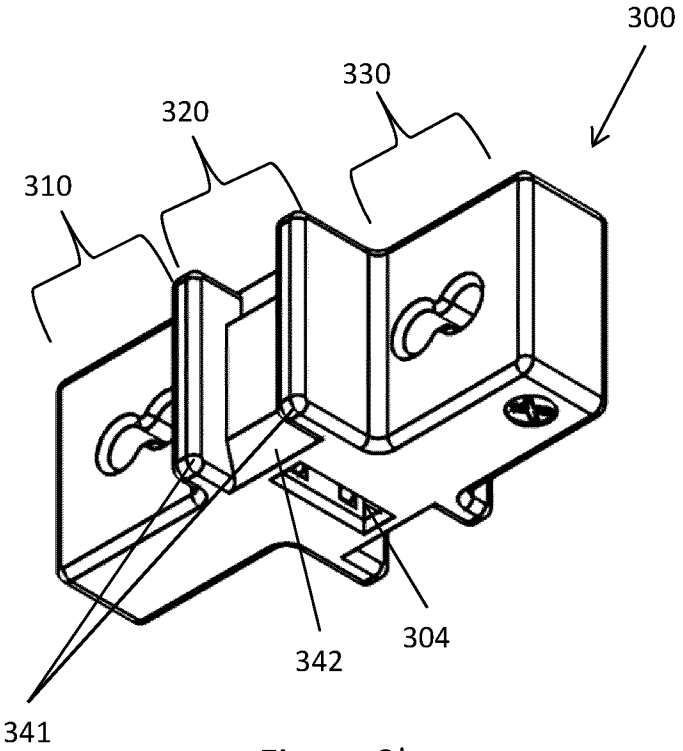
FIG. 3*b* depicts a second isometric view of an insulated housing in accordance with an illustrative embodiment.
Figure 3A:
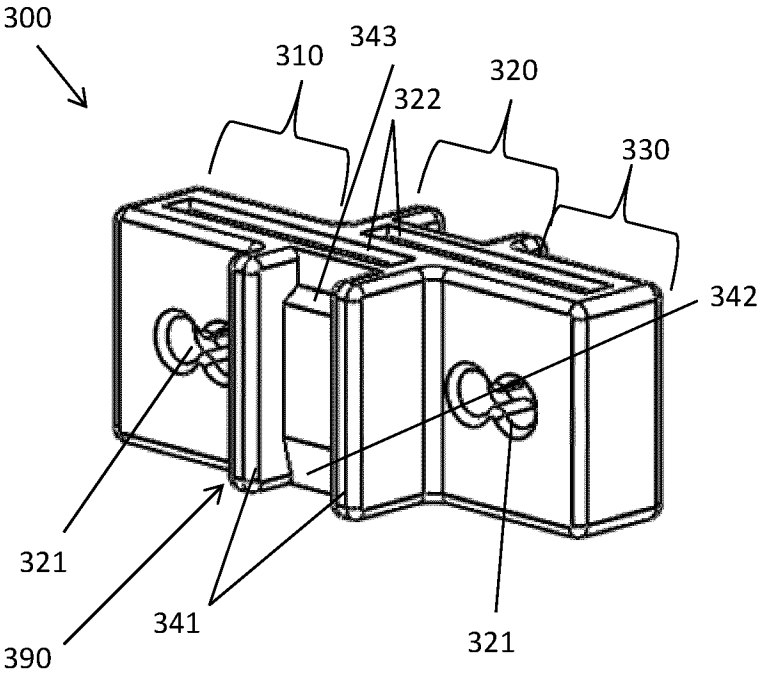
FIG. 3*a* depicts an isometric view of an insulated housing in accordance with an illustrative embodiment.

Referring to FIGS. 3*a* and 3*b*, two different isometric views of an insulated housing are depicted in accordance with various illustrative embodiments. FIG. 3*a* depicts an isometric view of an insulated housing 300 in accordance with an illustrative embodiment. FIG. 3*b* depicts a second isometric view of an insulated housing 300 in accordance with an illustrative embodiment. In an embodiment, the insulated housing 300 is formed as a single non-conductive material. The non-conductive material may be any material that does not readily conduct electricity and provides a rigid, sturdy structure.

Referring to FIG. 3*a*, the insulated housing 300 includes wire openings 321, electrical contact inlets 322, and a latching portion 343. The insulated housing 300 also includes a shunt opening 304 that is not depicted in FIG. 3*a*, but is depicted in FIG. 3*b*. To aid in its description, the insulated housing 300 is defined as three separate portions: the left portion 310, the middle portion 320, and the right portion 330. In an embodiment, there may be one, two, three, four, or more wire openings in the insulated housing 300. For example, there may be one wire opening 321 on the left portion 310, and one wire opening 321 on the right portion 330. Alternatively, there may be two wire openings 321 on each of the left and right portions 310 and 330. The wire openings 321 may be mutually exclusive or connected. That is, the wire openings 321 may be separately formed such that the wire openings 321 do not overlap. Alternatively, two wire openings 321 on the same portion of the insulated housing 300 may slightly overlap, as depicted in FIGS. 3*a*, and 3*b*. The wire openings 321 extend entirely through the insulated housing 300 and are designed to receive a wire. The diameter of the wire openings 321 is equal to, or slightly larger, than the diameter of the wire that the wire openings 321 are designed to receive. In other words, the diameter of the wire openings 321 will be different depending upon the applicable conditions of the project for which the wire-to-wire connector is being used. Further, the size of the wire openings 321 on the same insulated housing 300 may be different. For example, the size of a wire opening 321 on the left portion 310 of the insulated housing 300 does not need to be equal to the size of a wire opening 321 on the right portion 320 of the insulated housing.

Figures 6A, 6B, 6C:
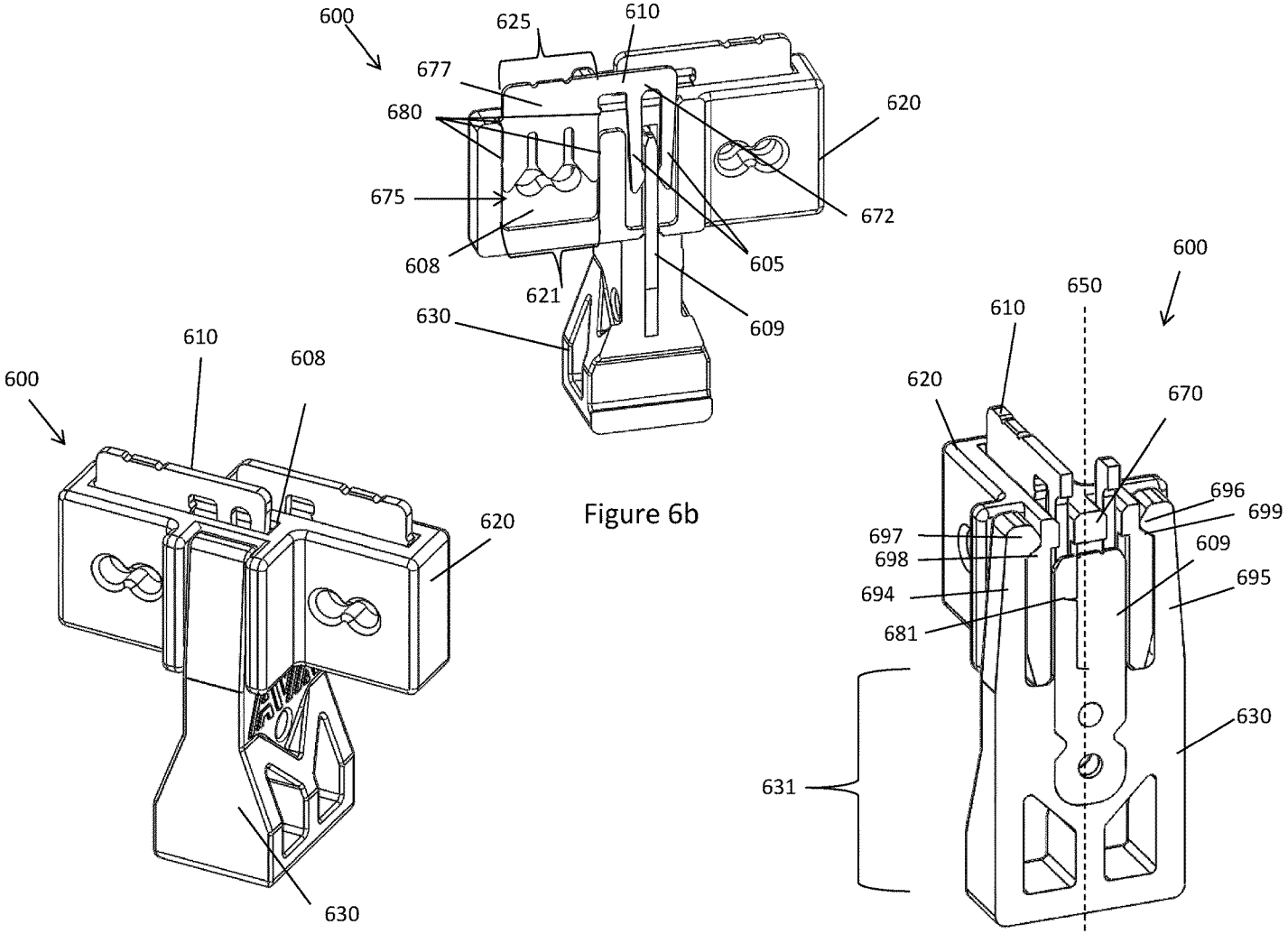
FIG. 6*a* depicts an isometric view of a wire-to-wire connector with wires inserted therein in accordance with an illustrative embodiment.
FIG. 6*b* depicts a first cross-sectional view of a wire-to-wire connector with wires and in accordance with an illustrative embodiment.
FIG. 6*c* depicts a second cross-sectional view of a wire-to-wire connector with wires inserted therein in accordance with an illustrative embodiment.

The electrical contact inlets 322 of the insulated housing 300 are designed to receive respective electrical contacts. FIG. 6*c* below provides an isometric cut-away view of the inside of the contact inlets 322. The electrical contact inlets 322 have a depth that is equal to (or slightly greater than) the depth of the electrical contact, a width equal to (or slightly greater than) the width of the electrical contact, and a length equal to (or slightly greater than) the length of the electrical contact. In other words, the electrical contacts are flush with (or slightly depressed relative to) the outside of the insulated housing 300 when the electrical contacts are inserted into respective electrical contact inlets 322. In an embodiment, the electrical contact inlets 322 do not extend entirely through the insulated housing. That is, the electrical contact inlets 322 may have a bottom that stops an electrical contact from being pushed through the housing.

The latching portion 390 is depicted in both FIGS. 3*a* and 3*b*. The latching portion 390 is on two opposing sides of the insulated housing 300. The latching portion 390 on each side includes two rails 341, a tapered receiving edge 322, and a tapered locking edge 343. The two rails 341 are situated a distance apart from each other to ensure that a corresponding latching prong may engage with the latching portion 390. Further, the rails 341 limit the lateral movement of the insulated housing 300 when it is engaged with a compatible device. Similarly, the tapered receiving edge 342 extends outward from the vertical centerline of the insulated house at an angle to allow a male latch prong (e.g., from an electrical shunt) to engage the insulated housing 300. Lastly, the tapered locking edge 343 extends from an outward position back toward the vertical centerline of the insulated housing 300 at an angle that allows a male latch prong to secure the insulated housing 300 to a compatible device. The entire space between the tapered receiving edge 322 and the tapered locking edge 343 is a consistent distance from the vertical centerline in order to allow a corresponding device to fully and smoothly engage with the insulated housing 300. In alternative embodiments, the latching portion 390 may be of any configuration that allows for a corresponding shunt to be securely engaged with the insulated housing 300.

Referring generally to FIG. 3*b*, the shunt opening 304 is depicted as a rectangular opening. The electrical contact inlets 322 extend into the insulated housing 300 along respective planes that are parallel to each other (i.e., the planes that are defined by the depth and longer edge of the electrical contact inlets 322). The shunt opening 304 extends into the insulated housing 304 along a third plane that is perpendicular to the respective planes along which the electrical contact inlets 322 extend into the insulated housing 300. In alternative embodiments, the shunt opening 304 may be of any polygonal shape that is large enough to receive a corresponding shunt. The shunt opening 304 has a depth that is great enough to allow a corresponding shunt to engage with the insulated housing 300 and to create an electrical and mechanical connection with electrical contacts in the electrical contact inlets 322 of the insulated housing 300.

Figure 4:
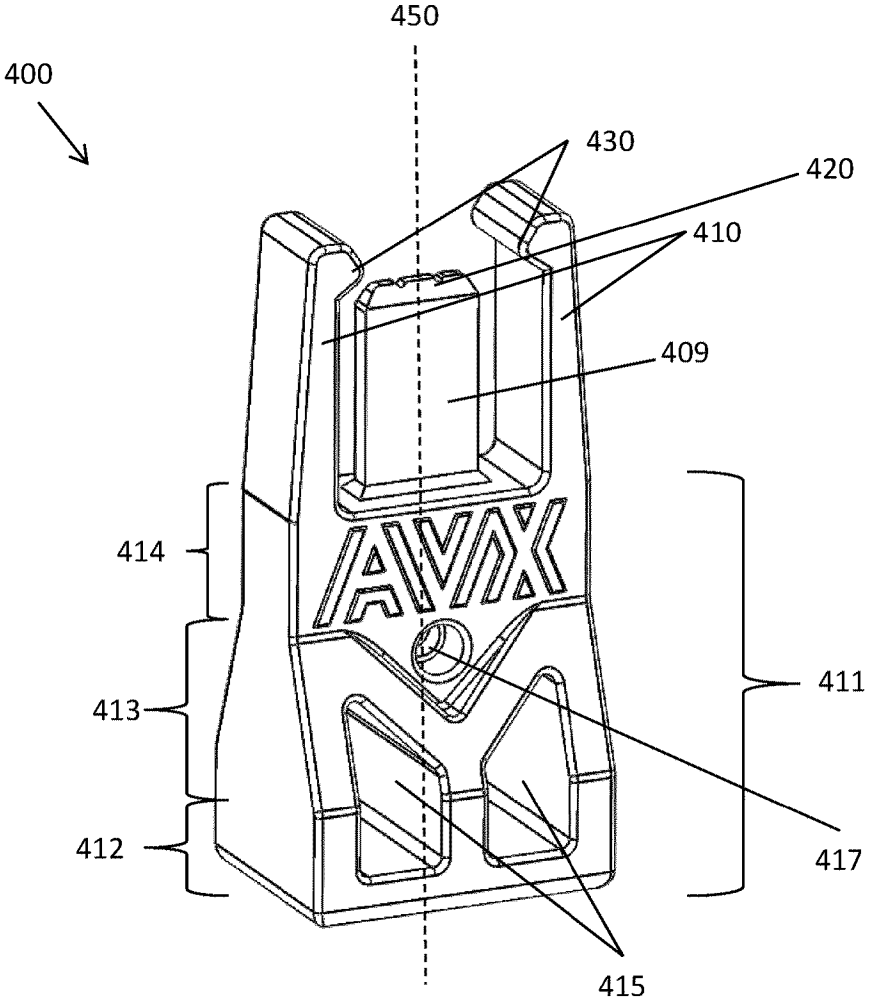
FIG. 4 depicts an isometric view of an electrical shunt in accordance with an illustrative embodiment.

FIG. 4 depicts an isometric view of an electrical shunt 400 in accordance with an illustrative embodiment. The electrical shunt 400 includes a male contact prong 409, latching prongs 410, and a shunt molding 411. In an embodiment, the male contact prong 409 is an approximately rectangular-shaped conductive element that consists of a single piece of an electrically conductive element. In alternative embodiments, the male contact prong 409 may have alternative shapes and may include multiple conductive elements designed into any shape that allows the shunt to engage with two or more electrical contacts. The male contact prong 409 includes a tapered edge 420 at a distal end. The tapered edge 420 allows for the male contact prong 409 to be easily inserted into a corresponding female socket. The male contact prong 409 is mechanically connected to the shunt molding 411 at a proximal end opposite the distal end.

In an embodiment, the shunt molding 411 is molded from a single piece of non-conductive material. In alternative embodiments, the shunt molding 411 may be multiple non-conductive parts that are mechanically coupled together. The shunt molding 411 includes a base portion 412, a transition portion 413, and a connective portion 414. The overall size of the base portion 412 may change depending upon the application. In alternative embodiments, the electrical shunt 400 may include only a male contact prong 409 (e.g., a metal contact) that can shunt a first and second electrical contact together and may omit an non-conductive, plastic body.

The transition portion 413 is connected to an end of the base portion 412. The transition portion 413 includes two tapered sides that connect the connective portion 414 to the base portion 412. The transition portion 413 allows for the electrical shunt 400 to be gripped and handled when being engaged or disengaged with a corresponding insulated housing. The connective portion 414 is connected to the transition portion 414, the male contact prong 409, and the latching prongs 410. The latching prongs 410 extend from the connective portion 414 and are substantially parallel to the male contact prong 409. Knobs 430 are located at the distal ends of the latching prongs 410 and extend toward the vertical centerline 450 of the electrical shunt 400. The knobs 430 allow the latching prongs to securely latch onto a corresponding latching portion (e.g., a tapered locking edge of the insulating housing 300). In some embodiments, the knobs 430 may be shaped as half-circles, rectangles, triangles, or any other polygonal shape that allow for the latching prongs 410 to mechanically secure the electrical shunt 400 to a corresponding device. The latching prongs 410 extend a greater distance than the male contact prong 409 from the connective portion 414. This allows for the electrical shunt 400 to be efficiently aligned with a corresponding insulated housing. In other words, the latching prongs 410 will engage with a corresponding latching portion of the insulated housing and the male contact prong 409 may slide into its corresponding opening with minimal adjustment. Furthermore, the male contact prong 409 extends along a first plane from the shunt molding 411 to the furthest extent of the male contact prong 409 (i.e., the distal end having the tapered edge 420). The latching prongs 410 may be centered on the first plane.

The shunt molding 411 also contains openings 415 and a hole 417 that extend entirely through the electrical shunt 400. Furthermore, the openings 415 and the hole 417 may be used in order to tie or secure the electrical shunt to another object. For example, it may be beneficial in some applications to secure the electrical shunt to a plank, rock, vehicle, etc.

Figure 5B:
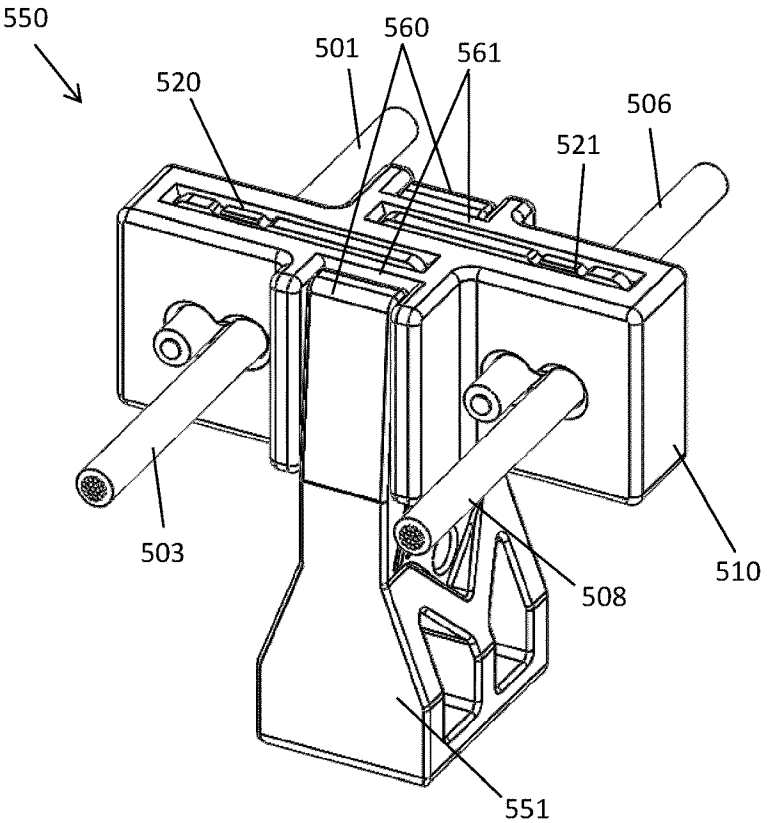
FIG. 5*b* depicts an isometric view of a wire-to-wire connector with wires inserted therein and an electrical shunt engaged in accordance with an illustrative embodiment.
Figure 5A:
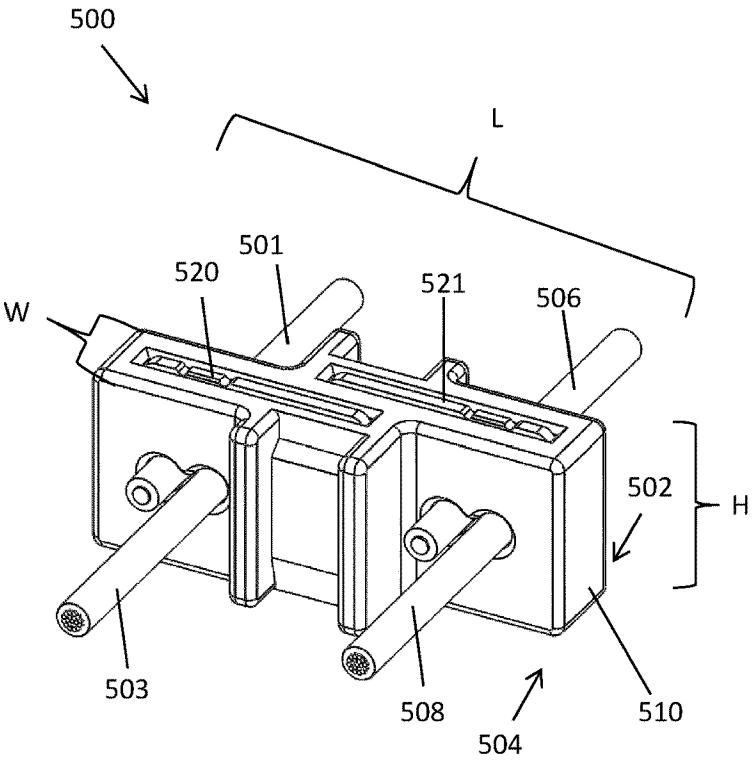
FIG. 5*a* depicts an isometric view of a wire-to-wire connector with wires inserted therein and electrical shunt removed in accordance with an illustrative embodiment.

FIG. 5*a* depicts an isometric view of a wire-to-wire connector 500 with wires inserted therein and electrical shunt removed in accordance with an illustrative embodiment. More specifically, FIG. 5*a* depicts four wires inserted therein in an insulated housing 510 with electrical contacts 520 and 521. In an example embodiment, the width W of the insulated housing 510 is 8.0 mm, the length L of the insulated housing 510 is 17.2 mm, and the height H of the insulated housing 510 is 7.0 mm. In alternative embodiments, W, L, and H may be varied depending upon the specific application.

In FIG. 5*a*, two solid core wires 501 and 506 are shown as inserted from the rear 502, and two stranded core wires 503 and 508 are shown inserted from the front 504. It is to be appreciated the wire-to-wire connector 500 may be sized to facilitate use with any type or size of wire. Furthermore, it is to show that a wire may be inserted into the wire-to-wire connector 500 either from the rear 502 or the front 504. The electrical contact 520 is electrically coupled to wires 501 and 503, and electrical contact 521 is electrically coupled to wires 506 and 508. In other words, electrical contact 520 has displaced the insulation of and formed mechanical and electrical connections with wires 501 and 503, and electrical contact 521 has displaced the insulation of and formed mechanical and electrical connections with wires 506 and 508. However, there is no electrical coupling between electrical contact 520 and electrical contact 521 because an electrical shunt is not engaged with the electrical contacts 520 and 521.

FIG. 5*b* depicts the wire-to-wire connector 500 of FIG. 5*a* with an electrical shunt 551 engaged. Two latching prongs 560 of the electrical shunt 551 are connected with a latching portion 561 of the insulated housing 510, thereby creating a secure mechanical connection between the insulated housing 510 and the electrical shunt 551. In this embodiment, the wires 501 and 503 are electrically coupled to the electrical contact 520, the electrical contact 520 is electrically coupled to the electrical contact 521 via the electrical shunt 551, and the electrical contact 521 is electrically connected to the wires 506 and 508. In other words, wires 501, 503, 506, and 508 are all electrically connected via the electrical contacts 520 and 521 and the electrical shunt 551.

Referring to FIGS. 6*a*, and 6*b*, and 6*c*, three different isometric views of a wire-to-wire connector 600 with shunt engaged are depicted in accordance with various illustrative embodiments. FIG. 6*a* depicts an isometric view of the wire to wire connector 600, FIG. 6*b* depicts a first cut-away isometric view of the wire to wire connector 600, and FIG. 6*c* depicts a second cut-away isometric view of the wire to wire connector 600. The wire-to-wire connector includes an electrical contact 610, an insulated housing 620, and an electrical shunt 630.

FIG. 6*a* depicts the electrical contact 610 partially inserted into a respective contact inlet 608 of the insulated housing 620. Additionally, the electrical shunt 630 is fully engaged with the insulated housing 620. FIG. 6*b* depicts a cut-away view of FIG. 6*a*. Specifically, FIG. 6*b* depicts the inside of a cross-section of the insulated housing 620 with the partially inserted electrical contact 610 mechanically and electrically coupled to the electrical shunt 630. Referring generally to FIG. 6*b*, the contact inlet 608 is molded such that the electrical contact 610 can be reliably secured within the insulated housing 620 with little movement. Specifically, the inlet is molded such that the depth of any portion of the electrical contact inlet 608 is greater than or equal to any corresponding height of the respective electrical contact 610. In addition, the electrical contact inlet 608 is molded to a shape substantially similar to the electrical contact 610.

Additionally, a width 621 of an insulation displacement connector portion 675 of the contact inlet 608 is about equal to a width 625 of the insulation displacement portion 677 of the electrical contact 610. This ensures that the electrical contact 610 is securely placed inside the contact inlet 608. Juts 680 extend outwardly from the insulation displacement portion 677 of the electrical contact 610 and engage an inner surface of the insulated housing 620. In an embodiment, the engagement of the juts 680 with the insulated material of the insulated housing 620 provides a frictional force sufficient to increase retention of the electrical contact 610 within the insulated housing 620. In alternative embodiments, the contact inlet 608 may be molded to have recesses that would engage the juts 680 when the electrical contact 610 is fully inserted into the contact inlet 608.

A shunt connector portion 672 of the electrical contact 610 electrically and mechanically couples to the male contact prong 609 of the electrical shunt 630. The contact tines 605 of the shunt connector portion 672 compress the male contact prong 609 and create an electrical connection between the electrical contact 610 and the male contact prong 609. As discussed above, wires may be received by the wire openings 621 and then the electrical contact 610 may be fully inserted into the insulated housing 620. Downward force on the electrical contact 610 would cause the blades of the insulation displacement connector portion 677 to engage the wires and create an electrical connection therebetween. Thus, an electrical connection would be created between the received wire, the electrical contact 610, and the male contact prong 609.

FIG. 6*c* depicts a perpendicular cut-away view of FIG. 6*a*. Specifically, FIG. 6*c* depicts the male contact 609 prong fully inserted into a shunt opening 690 of the insulated housing 620. Additionally, two latching prongs 694 and 695 extend from the shunt molding 630. The two latching prongs 694 and 695 extend parallel to one another. Each of the two latching prongs 694 and 695 have a knob 697 and 696 at their distal end. The knobs 697 and 696 extend inwardly towards the vertical centerline 650 of the shunt molding 630. The two latching prongs 694 and 695 are spaced a distance apart that allows for electrical shunt 620 to engage the insulated housing 620. Upon engagement of the insulated housing 620 to the electrical shunt 630, the knobs 697 and 697 of the two latching prongs 694 and 695 compress and sit above tapered locking edges 698 and 699 of the latching portion of the insulated housing 620, thus ensuring that the insulated housing 620 and the electrical shunt 630 cannot be inadvertently separated.

A depth 681 of the shunt opening is greater than or equal to the length of the male contact prong 609 that protrudes from the shunt molding 630. This ensures that the insulated housing 620 and the electrical shunt 630 achieved complete mechanical coupling. In addition, a spacer 670 separates the two electrical contacts 610 and ensures that when the shunt is removed that the two electrical contacts 610 are electrically and mechanically isolated. The spacer 670 is part of the molding of the insulated housing 620. In alternative embodiments, the spacer 670 may not be part of the molding of the insulated housing 620.

Figure 7:
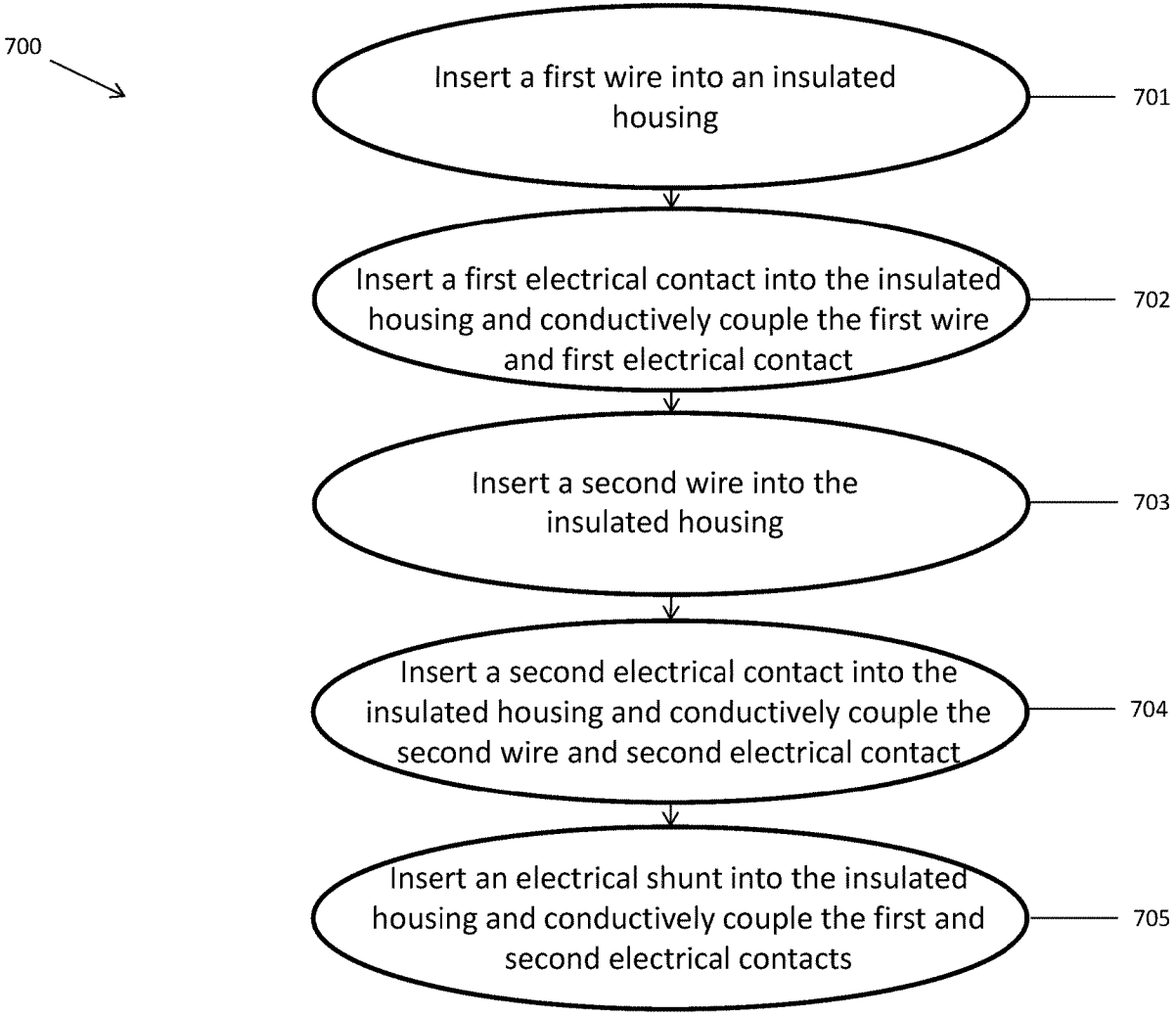
FIG. 7 depicts a flow diagram for a method of use of a wire-to-wire connector in accordance with an illustrative embodiment.

FIG. 7 depicts a first method 700 of use of a wire-to-wire connector in accordance with an illustrative embodiment. In an operation 701, a first wire is inserted into a first wire opening of the insulated housing. In an operation 702, a first electrical contact is compressed into a first electrical contact inlet of the insulated housing. The first electrical contact displaces the insulation of the first wire and creates an electrical and mechanical connection between the first electrical contact and the conductive core of the first wire. Furthermore, the first electrical contact includes a first shunt connector portion that is separate from the portion that displaces the insulation of the wire. In an operation 703, a second wire is inserted into a second wire opening the insulated housing. In an operation 704, a second electrical contact is compressed into a second electrical contact inlet of the insulated housing. The second electrical contact displaces the insulation of the second wire and creates an electrical and mechanical connection between the second electrical contact and the conductive core of the second wire.

In an operation 705, a male contact prong is inserted into a shunt opening of the insulated housing. The male contact prong creates an electrical and mechanical connection to the first shunt connector portion of the first electrical contact and to the second shunt connector portion of the second electrical connector. As a result, the first electrical contact is conductively connected to the second electrical contact. Moreover, the first wire is conductively connected to the second wire via the electrical contacts and the male contact prong.

Figure 8:
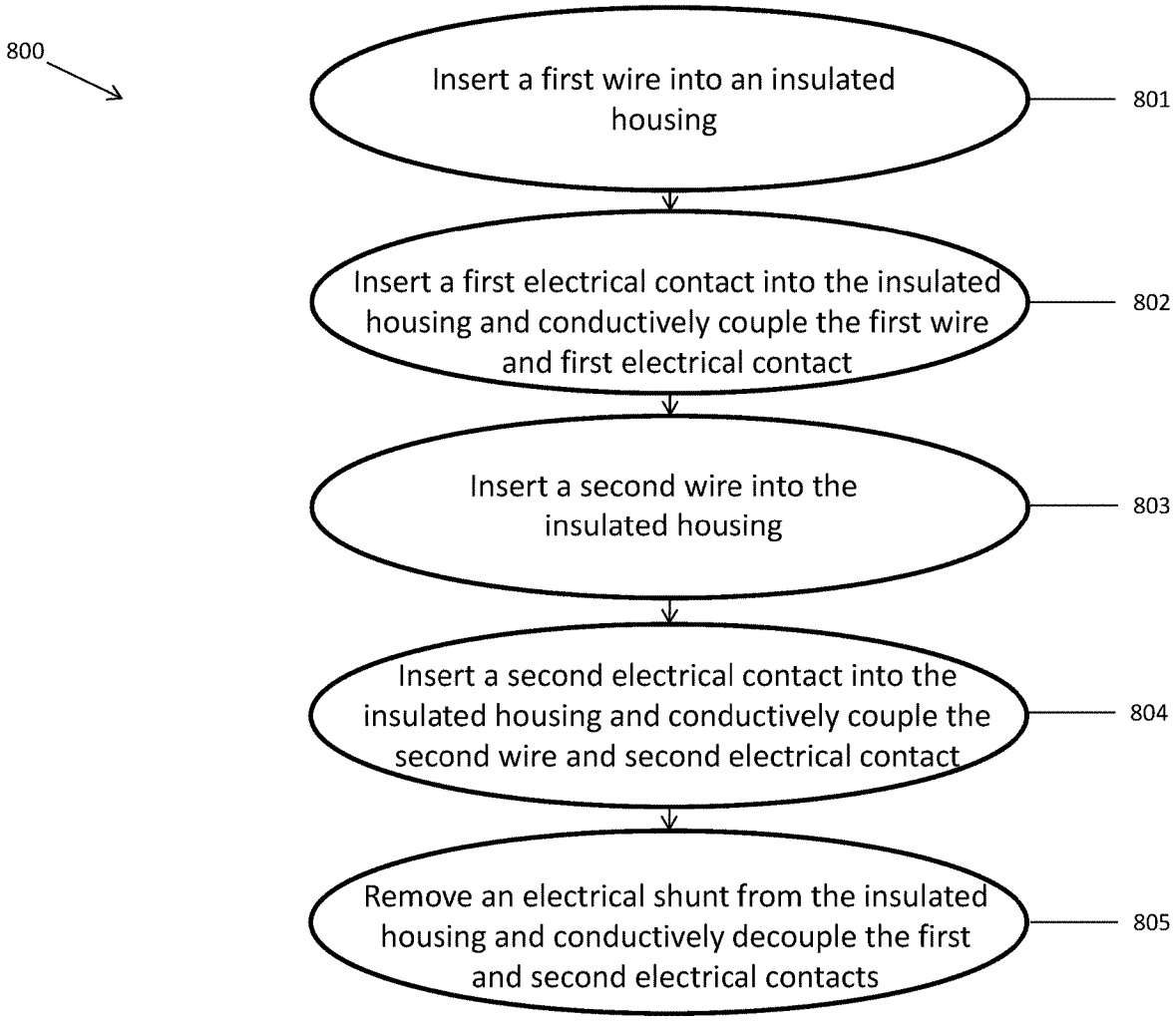
FIG. 8 depicts a flow diagram for a method of use of a wire-to-wire connector in accordance with an illustrative embodiment.

FIG. 8 depicts a second method 800 of use of a wire-to-wire connector in accordance with an illustrative embodiment. In an operation 801, a first wire is inserted into a first wire opening of an insulated housing. In an operation 802, a first electrical contact is compressed into a first electrical contact inlet of the insulated housing. An insulation displacement connector of the first electrical contact displaces the insulation of the first wire and creates an electrical and mechanical connection between the first electrical contact and the conductive core of the first wire. Furthermore, the first electrical contact includes a first shunt connector portion that is connected to a male contact prong of an electrical shunt when it is compressed into the first contact inlet. In an operation 803, a second wire is inserted into a second wire opening of the insulated housing. In an operation 804, a second electrical contact is compressed into a second electrical contact inlet of the insulated housing. An insulation displacement connector of the second electrical contact displaces the insulation of the second wire and creates an electrical and mechanical connection between the second electrical contact and the conductive core of the second wire. Additionally, the second electrical contact includes a second shunt connector portion that is connected to the male contact prong of the electrical shunt when it is compressed into the second contact inlet.

In an operation 805, the male contact prong is removed from a shunt opening of the insulated housing. The removal of the male contact prong electrically and mechanically decouples the male contact prong from the first shunt connector portion of the first electrical contact and the second shunt connector portion of the second electrical contact. As a result, the first electrical contact is conductively decoupled from the second electrical contact. Furthermore, the first wire is conductively decoupled from the second wire.

Figures 9A, 9B:
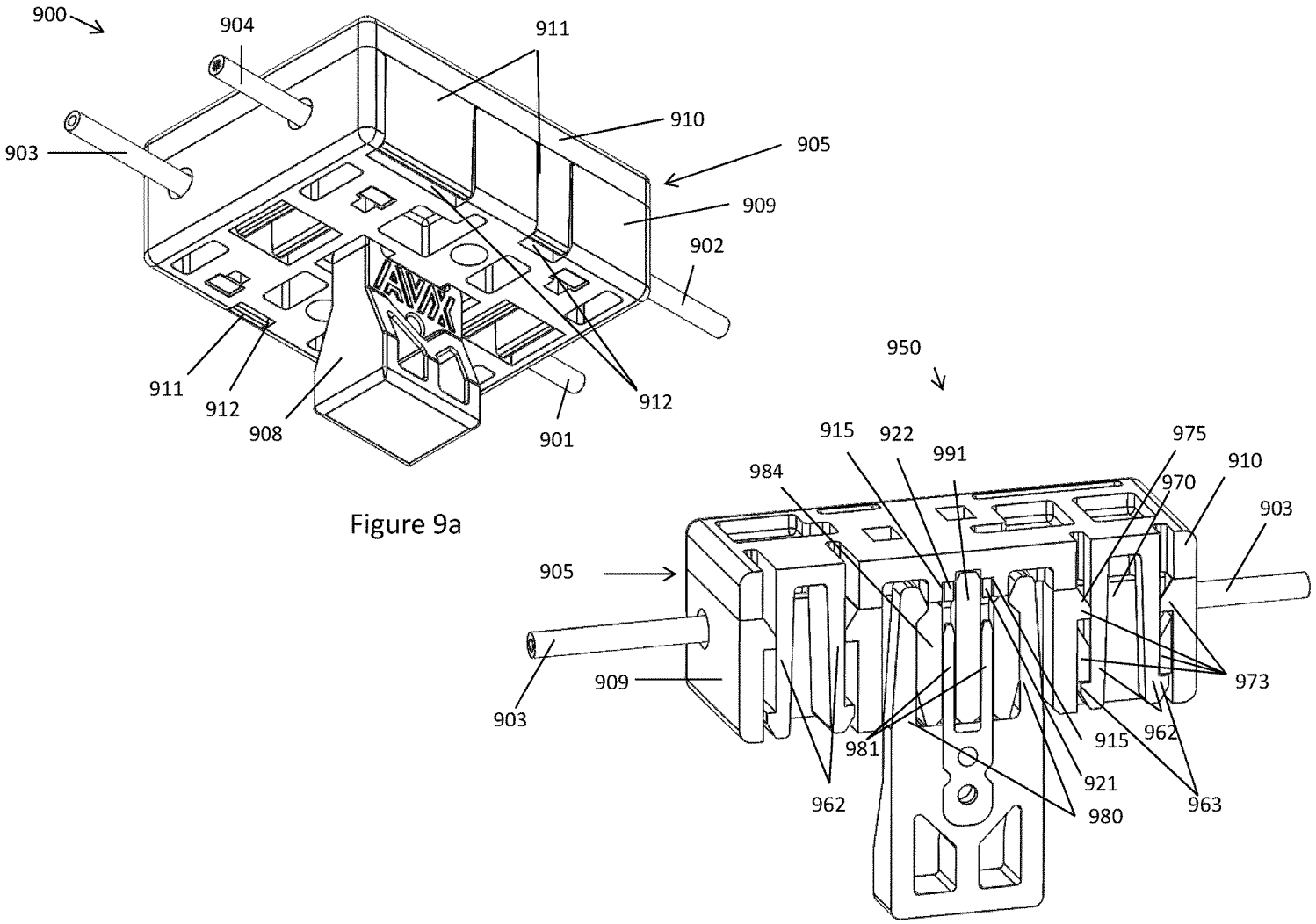
FIG. 9*a* depicts an isometric view of a wire-to-wire connector with wires inserted therein and an electrical shunt engaged in accordance with an illustrative embodiment.
FIG. 9*b* depicts a cross-section of a wire-to-wire connector with wires inserted therein and an electrical shunt engaged in accordance with an illustrative embodiment.

FIG. 9*a* depicts an isometric view of a wire-to-wire connector 900 having wires and an electrical shunt engaged therein in accordance with another illustrative embodiment. Specifically, four wires 901, 902, 903, and 904 are mechanically and electrically connected together via the wire-to-wire connector 900. The wire-to-wire connector 900 includes an insulated housing 905, two electrical contacts (not depicted), and an electrical shunt 908. The insulated housing 905 includes a housing base 909 and a housing cap 910. In an embodiment, the housing base 909 and the housing cap 910 are separable components. The housing cap 910 includes peripheral latching prongs 911 and the housing base 909 includes peripheral locking mechanisms 912. The peripheral latching prongs 911 and peripheral locking mechanisms 912 are designed such that the housing cap 910 and the housing base 909 can be mechanically secured together. In alternative embodiments, there may be more or fewer peripheral latching prongs 911 and peripheral locking mechanisms 912.

FIG. 9*b* depicts an isometric view of a cross-section of a wire-to-wire connector 950 having wires and an electrical shunt engaged in accordance with an illustrative embodiment. Specifically, FIG. 9*b* depicts two of the wires 901 and 903 inserted and secured within the insulated housing 905. The housing cap 910 also includes central latching prongs 962. The central latching prongs 962 are depicted as two prongs that have outward (from the other latching prong) facing knobs (e.g., locking edges) 963. The housing base 909 may also include central locking mechanisms 970. The central locking mechanisms 970 may include a cap locking portion 973. The cap locking portion 973 may include one cap ledge that allows for the locking edges 963 to mechanically secure the housing cap 910 to the housing base 909. Alternatively, as depicted, there may be tiered cap ledges in the cap locking portion 973. The tiered cap ledges in the cap locking portion 973 allows for the housing cap 910 to be mechanically connected to the housing base 909 without having the housing cap 910 and the housing base 909 fully engaged with one another. The partial connection (i.e., when the central latching prongs are over a first tier 975 of the cap ledges of the cap locking portion 973) between the housing cap 910 and the housing base 909 allows for wires to be inserted into the insulated housing 905 while ensuring that the components of the insulated housing 905 (and any electrical contacts between the housing cap 910 and the housing base 909) are secured in the correct position. The insulated housing 905 (and any electrical contacts in the insulated housing 905) may be shipped with a partial connection between the housing cap 910 and the housing base 909 to ensure that no components are separated and lost. The electrical shunt 908 includes two prongs 981 that are electrically connected and is discussed in further detail in FIGS. 11*a* and 11*b*.

FIG. 9*b* also depicts two electrical contacts 921 and 922 that are separated by a partition 991 of the housing base 909. In an embodiment, the partition 991 is a part of the housing base 909. In alternative embodiments, the partition 991 may be part of the housing cap 910, or a separable element that can be selectively inserted between the two electrical contacts 921 and 922. The partition 991 is an electrically insulated material that extends above the two electrical contacts 921 and 922 when the two electrical contacts 921 and 922 are fully inserted into respective electrical contact inlets of the housing base 909. Further, the partition 991 extends entirely between the two electrical contacts 921 and 922 (e.g., the entire length and height of the two electrical contacts 921 and 922) to ensure that an electrical potential difference between the two electrical contacts 921 and 922 (e.g., with the electrical shunt 908 removed) does not result in sparking or other potentially hazardous electrical events. The distance between the two prongs 981 is equal or slightly greater than the width of the partition 981 to ensure that the electrical shunt 908 can be electrically connected to the two electrical contacts 921 and 922. The housing base 909 also includes a shunt latching portion 984. The shunt latching portion 984 includes two recesses that include cap ledges that are designed to receive the latching prongs 980 of the electrical shunt. In other words, the latching prongs 980 can enter the shunt latching portion 984 of the housing base 909 in order to mechanically secure the electrical shunt 908 to the housing base 909.

The housing cap 910 includes electrical contact recesses 915. The electrical contact recesses 915 are recesses in the housing cap 910 that allow for the housing cap 910 to be partially connected with the housing base 909 without the housing cap making contact with the two electrical contacts 921 and 922. Specifically, the electrical contact recesses 915 allow for strain relieving cams (not depicted) of the insulated housing 905 to kink (e.g., pinch) and mechanically secure the wires before the electrical contacts 921 and 922 are fully inserted into their respective electrical contact inlets of the housing base 909. Allowing for the strain relieving cams (not depicted) of the insulated housing 905 to kink (or pinch) the wires before the electrical contacts 921 and 922 displace the insulation of the wires ensures that electrical connection between the wires and electrical contacts 921 and 922 is secure and reliable. That is, if the strain relieving cams (not depicted) of the insulated housing 905 kink (or pinch) the wires after (or while) the electrical contacts 921 and 922 engage with the wires, then the kinking (or pinching) could cause strain in the wires between the electrical contacts 921 and 922 and the strain relieving cams (not depicted).

Figure 10B:
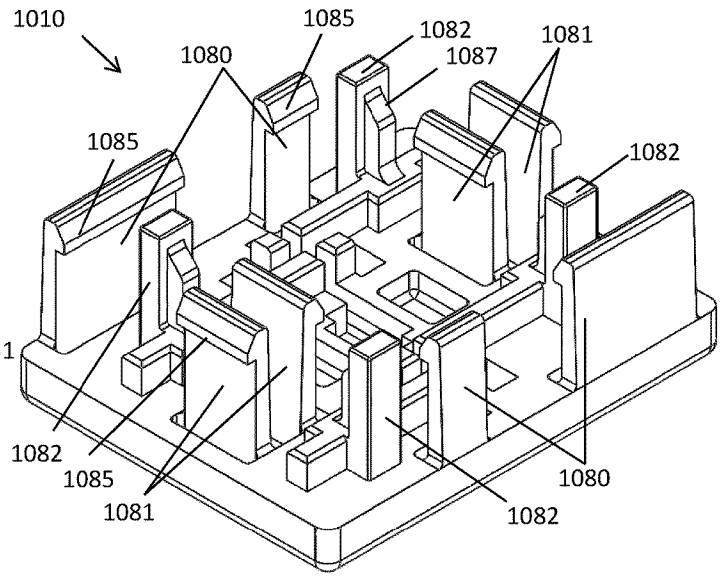
FIG. 10*b* depicts an isometric view of an up-side-down housing cap of an insulated housing in accordance with an illustrative embodiment.
Figure 10A:
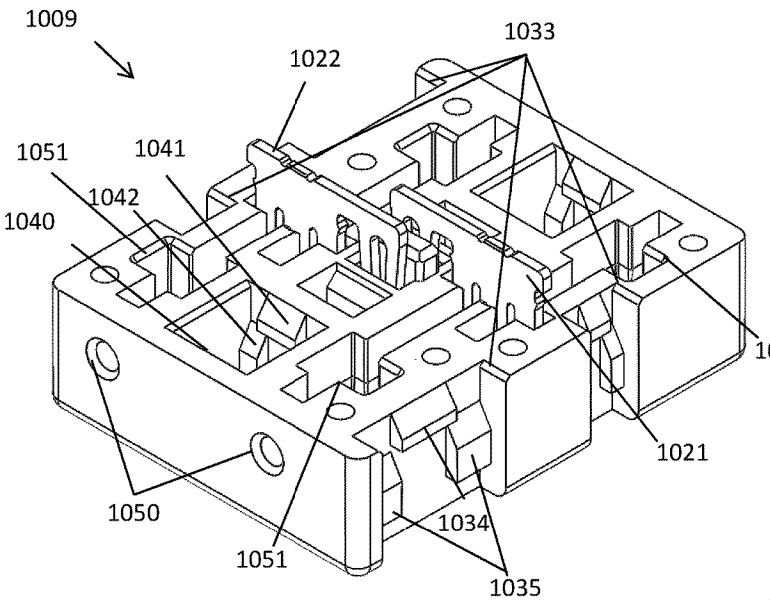
FIG. 10*a* depicts an isometric view of a housing base of an insulated housing in accordance with an illustrative embodiment.
Figure 10C:
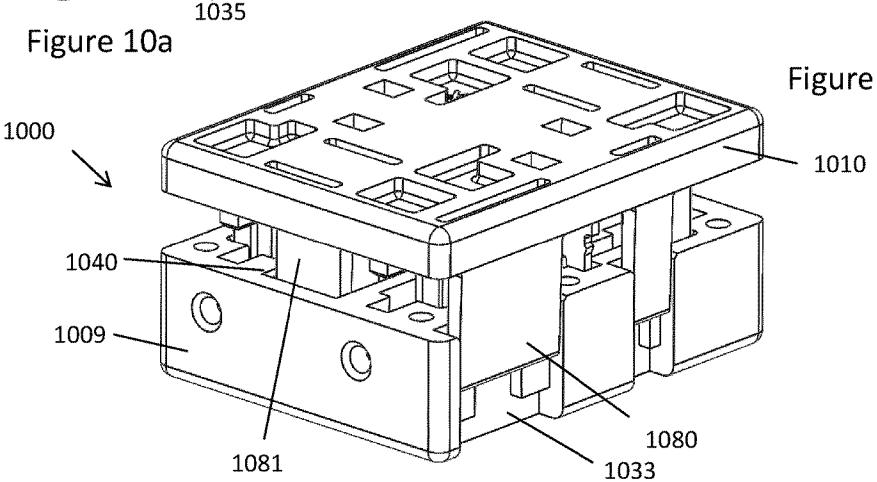
FIG. 10*c* depicts an isometric view of an insulated housing in accordance with an illustrative embodiment.

FIG. 10*a* depicts an isometric view of a housing base 1009 of an insulated housing in accordance with an illustrative embodiment. FIG. 10*b* depicts an inverted isometric view of a housing cap 1010 of an insulated housing in accordance with an illustrative embodiment. FIG. 10*c* depicts an isometric view of an insulated housing 1000 in accordance with an illustrative embodiment.

FIG. 10*a* generally depicts a housing base 1009 with two electrical contacts 1021 and 1022 partially placed in respective electrical contact inlets. The housing base 1009 includes peripheral latching mechanisms 1033. As stated above, the peripheral latching mechanisms 1033 may include a first tier of cap ledges 1034 and a second tier of cap ledges 1035. The two tiers of cap ledges 1034 and 1035 allow for a housing cap to be installed in a first position (e.g., when the latching prongs of the housing cap are installed over the first tier of cap ledges 1034) and a second position (e.g., when the latching prongs of the housing cap are installed over the second tier of cap ledges 1035). The housing base 1009 includes center locking mechanisms 1040. The center locking mechanism 1040 may also include a first tier of cap ledges 1041 and a second tier of cap ledges 1042. In alternative embodiments, the number and position of the cap ledges on each tier may be different or in different locations. That is, they may be in any position that allows for a housing cap to be installed (and mechanically secured) to the housing base. In yet alternative embodiments, there may only be one tier of cap ledges.

The housing base 1009 also includes wire openings 1050. In an embodiment, the wire openings 1050 extend entirely through the housing base 1009. In alternative embodiments, the wire openings 1050 extend to a distance past one of the electrical contacts 1021 and 1022, but not entirely through the housing base 1009. The housing base 1009 also includes a cam receiving portion 1051. In an embodiment, there is a cam receiving portion 1051 corresponding to each wire opening 1050.

FIG. 10*b* depicts a housing cap 1010. The housing cap 1010 includes peripheral latching prongs 1080, center locking prongs 1081, and strain relieving cams 1082. The peripheral latching prongs 1080 include locking edges 1085 that protrude from the peripheral latching prongs 1080 toward the center of the housing cap 1010. The center locking prongs 1081 also include locking edges 1085. The locking edges 1085 may be of any size or geometrical shape that allow for the peripheral latching prongs 1080 to engage (i.e., mate) with cap locks on a corresponding housing base. In an embodiment, the peripheral latching prongs 1080, center locking prongs 1081, and strain relieving cams 1082 all extend the same distance in the same direction.

Each strain relieving cam 1082 includes cam portion 1087. The cam portion 1087 is tapered such that when the strain relieving cam 1083 is installed into a corresponding cam receiving portion that the cam portion 1087 engages with a wire positioned within the corresponding cam receiving portion and forces the wire to be kinked. The kink of the wire mechanically secures the wire between the housing cap 1010 and the corresponding housing base 1009.

FIG. 10*c* depicts a housing cap 1010 installed in a first position relative to a housing base 1009. That is, peripheral and center latch prongs 1080 and 1081 of the housing cap 1010 have been engaged in a first position with peripheral and central locking mechanisms 1033 and 1040 of the housing base 1009. In other words, the peripheral and center latch prongs of the housing cap 1010 have been engaged over a first tier of cap ledges of the peripheral and central locking mechanisms of the housing base 1009.

Figure 11B:
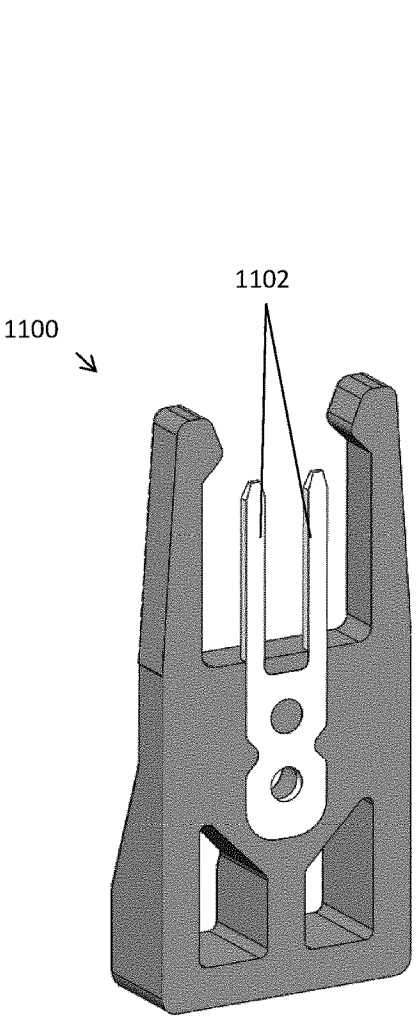
FIG. 11*b* depicts an isometric view of a cross-section of an electrical shunt in accordance with an illustrative embodiment.
Figure 11A:
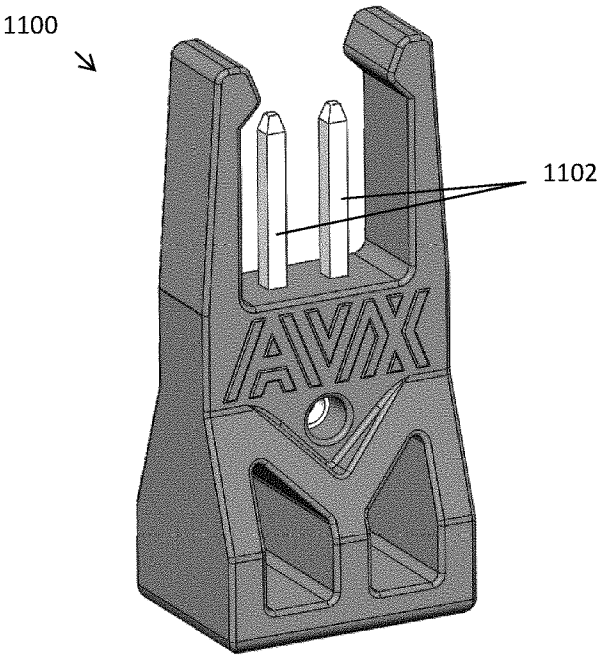
FIG. 11*a* depicts an isometric view of an electrical shunt in accordance with an illustrative embodiment.

FIG. 11*a* depicts an isometric view of an electrical shunt 1100 in accordance with an illustrative embodiment. FIG. 11*b* depicts an isometric view of a cross-section of an electrical shunt 1100 in accordance with an illustrative embodiment. The electrical shunt 1100 of FIGS. 11*a* and 11*b* is similar to electrical shunt 400 of FIG. 4. However, the electrical shunt 1100 of FIGS. 11*a* and 11*b* includes two contact prongs 1102. The two contact prongs 1102 allow for a corresponding housing to be designed such that there is an insulated material between two electrical contacts that can be selectively shunted together by insertion of the electrical shunt 1100. Referring generally to FIG. 11*b*, the two contact prongs 1102 are components of a single contact element. In alternative embodiments, the two contact prongs 1102 may be two separate elements that are electrically and mechanically connected together. In another embodiment, each of the two contact prongs 1102 extends from an insulated portion or the electrical shunt 1100. That is, the conductive material connecting the two contact prongs 1102 is not exposed.

Figure 12B:
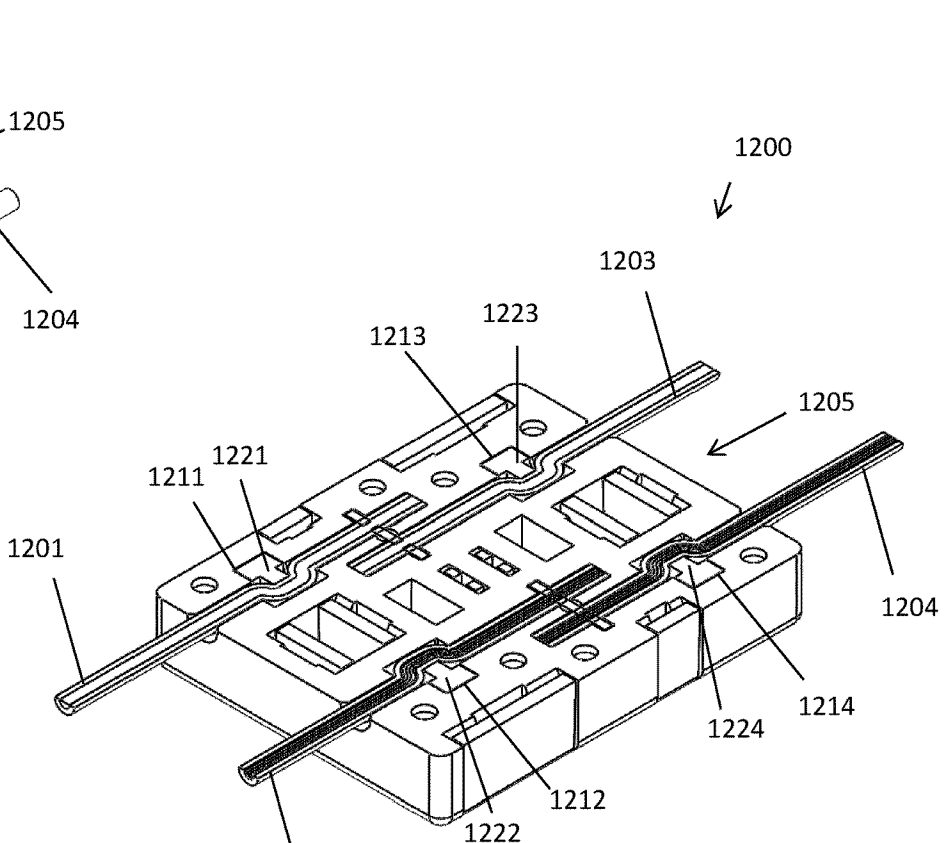
FIG. 12*b* depicts an isometric view of a cross-section of a housing base of an insulated housing with wires inserted therein in accordance with an illustrative embodiment.
Figure 12A:
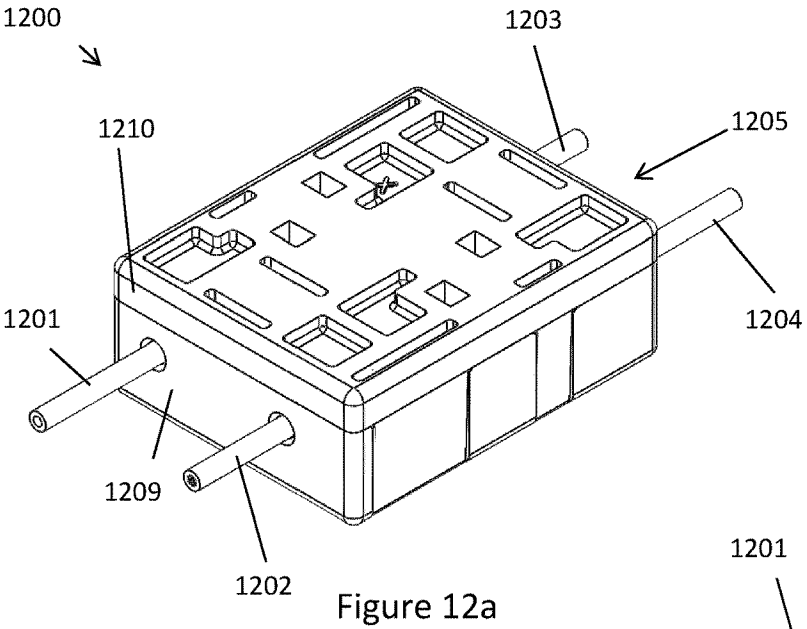
FIG. 12*a* depicts an isometric view of an insulated housing having wires inserted therein in accordance with an illustrative embodiment.

FIG. 12*a* depicts an isometric view a wire-to-wire connector 1200 with wires inserted therein in accordance with an illustrative embodiment. Specifically, FIG. 12*a* shows four wires 1201, 1202, 1203, and 1204 inserted and secured within an insulated housing 1205. FIG. 12*b* depicts an isometric view of a cross section of the insulated housing 1205 with wires inserted therein in accordance with an illustrative embodiment. Specifically, FIG. 12*b* is a cross-sectional view of the insulating housing 1205 in which four wires 1201, 1202, 1203, and 1204 is installed and fully seated insulated housing and the housing base is fully engaged with the housing cap 1210. Each of the four wires 1201, 1202, 1203, and 1204 have been kinked at respective cam receiving portions 1211, 1212, 1213, and 1214 of the insulated base. That is, strain relieving cams 1221, 1222, 1223, 1224 of the insulated cap have been positioned in respective cam receiving portions 1211, 1212, 1213, and 1214 of the insulated base, which caused each respective wire to be displaced (e.g., kinked) in the respective cam receiving portions 1211, 1212, 1213, and 1214. The kink mechanically secures the wire within the insulated housing 1200 and allows for electrical contacts to engage the wires in order to displace the insulation of the wire to create a mechanical and electrical connection between the wires and the electrical contacts. That is, the strain relieving cams 1221, 1222, 1223, 1224 of the insulated cap have kinked the wires before the electrical contacts have been compressed into their respective contact by the insulated cap, this ensures that there is no strain in the wire.

Figure 13A:
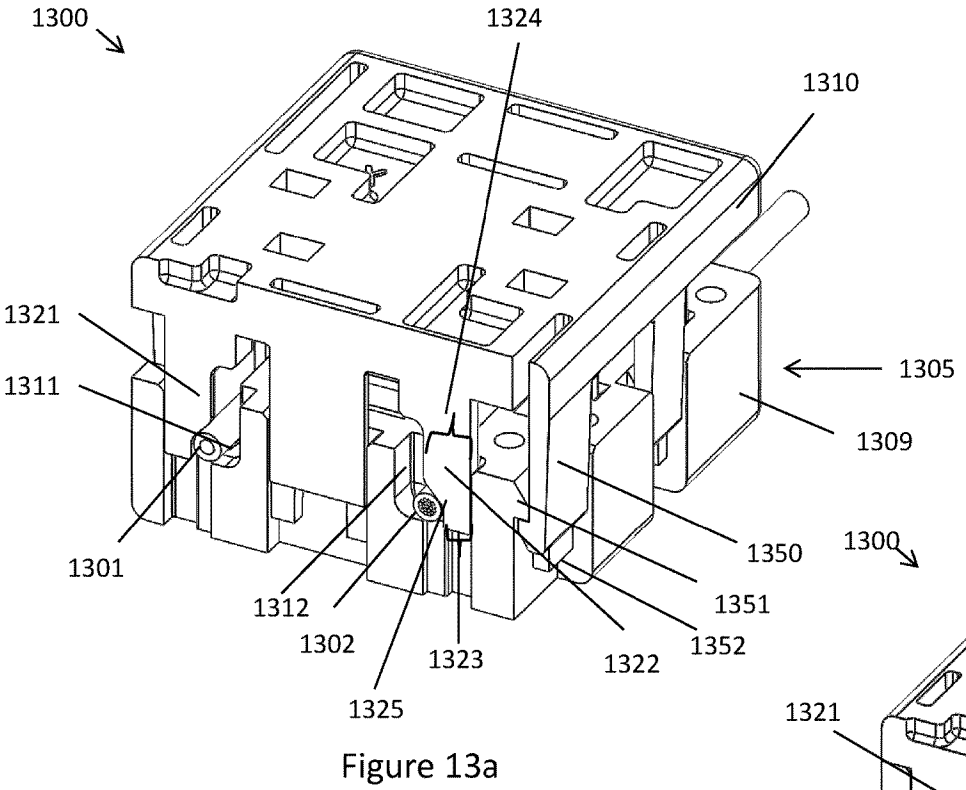
FIG. 13*a* depicts an isometric view of an end cross section of a wire-to wire connector in a first position having wires inserted therein in accordance with an illustrative embodiment.

FIG. 13*a* depicts an isometric view of an end cross section of a wire-to wire connector 1300 in a first position having wires inserted therein in accordance with an illustrative embodiment. An insulated housing 1305 includes a housing cap 1310 and a housing base 1309. The housing cap 1310 includes peripheral latch prongs 1350 that are latched over a first tier 1351 of peripheral latching mechanisms 1352 of the housing base 1309. The housing cap 1310 includes a two strain relieving cams 1321 and 1322. It is to be appreciated that this figure is to demonstrate the mechanics of a strain relieving cam and corresponding receiving portion. In an embodiment, there may be one, two, three, four, five or more strain relieving cams included on a housing cap. The strain relieving cams 1321 and 1322 include a first portion having a first width 1323 and a second portion having a second width 1324. Specifically, the first width 1323 is the width of the strain relieving cam 1322 at the distal end of the strain relieving cam 1322. The first width 1323 is sufficiently small such that the strain relieving cams 1321 and 1322 do not apply a force to the wires 1301 and 1302 when the strain relieving cams 1321 and 1322 are inserted into their respective cam receiving portions 1311 and 1322 of the housing base 1309. The second width 1324 is greater than the first width 1323. A tapered transition area 1325 of the strain relieving cams between the first width 1323 and the second width 1324 creates a cam portion of the strain relieving cams 1321 and 1322 that may be used to selectively secure the inserted wires. Specifically, the second width 1324 is great enough such that when strain relieving cams 1321 and 1322 are fully inserted into corresponding cam receiving portions 1311 and 1322, the second width 1324 (cam portion) applies a force to corresponding wires 1301 and 1302 and forces the wires 1301 and 1302 to move laterally relative to the movement of the strain relieving cams 1321 and 1322 (e.g., kink the wire). Additionally, the tapered transition area 1325 between the first width 1323 and the second width 1324 ensures that the wires 1301 and 1302 can be kinked (e.g., moved laterally) within the cam receiving portions 1311 and 1312 without damaging the insulation of the wires 1301 and 1302. In alternative embodiments, the tapered transition area 1325 may be any shape that allows for the strain relieving cams 1321 and 1322 to kink the wires 1301 and 1302 without damaging the insulation of the wires 1301 and 1302.

Figure 13B:
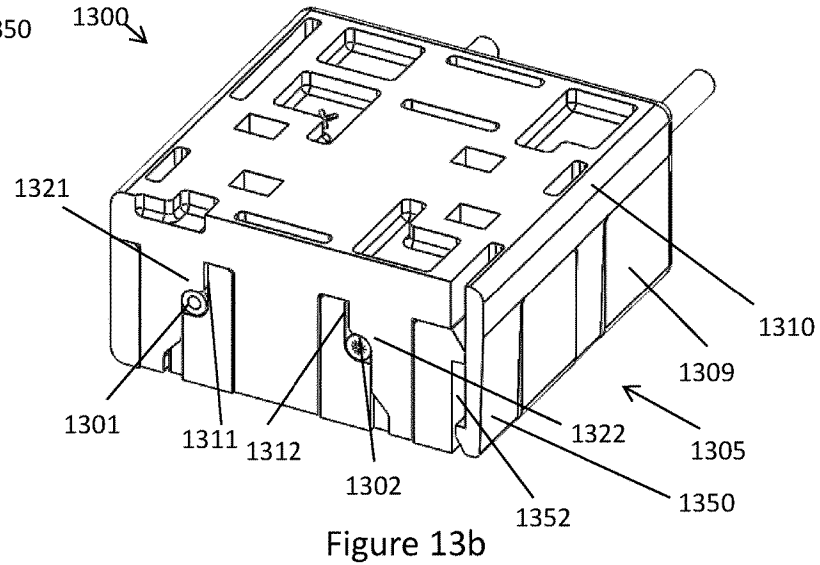
FIG. 13*b* depicts an isometric view of an end cross section of a wire-to wire connector in a second position having wires inserted and secured therein in accordance with an illustrative embodiment.

FIG. 13*b* depicts an isometric view of a cross section of the wire-to wire connector 1300 in a second position having wires inserted and secured therein in accordance with an illustrative embodiment. Specifically referring to FIG. 13*b*, the strain relieving cams 1321 and 1322 are fully engaged with the respective cam receiving portions 1311 and 1312. That is, the housing cap 1310 has been compressed onto the housing base 1309 and the peripheral latching prongs 1350 of the housing cap 1310 have been forced over the second tier of cap locks of the latching mechanism 1352 of the housing base 1309. The compression of the housing cap 1310 has forced the corresponding wires 1301 and 1302 to move laterally to the movement of the strain relieving cams 1321 and 1322 and the lateral movement of the wires 1301 and 1302 at a location corresponding to the second taper 1325 of the strain relieving cams 1321, 1322 caused the wires 1301, 1302 to be kinked (or pinched) within respective cam receiving portions 1311 and 1312. In this way, the wires 1301 and 1302 are mechanically secured within the insulated housing 1305.

Figure 14:
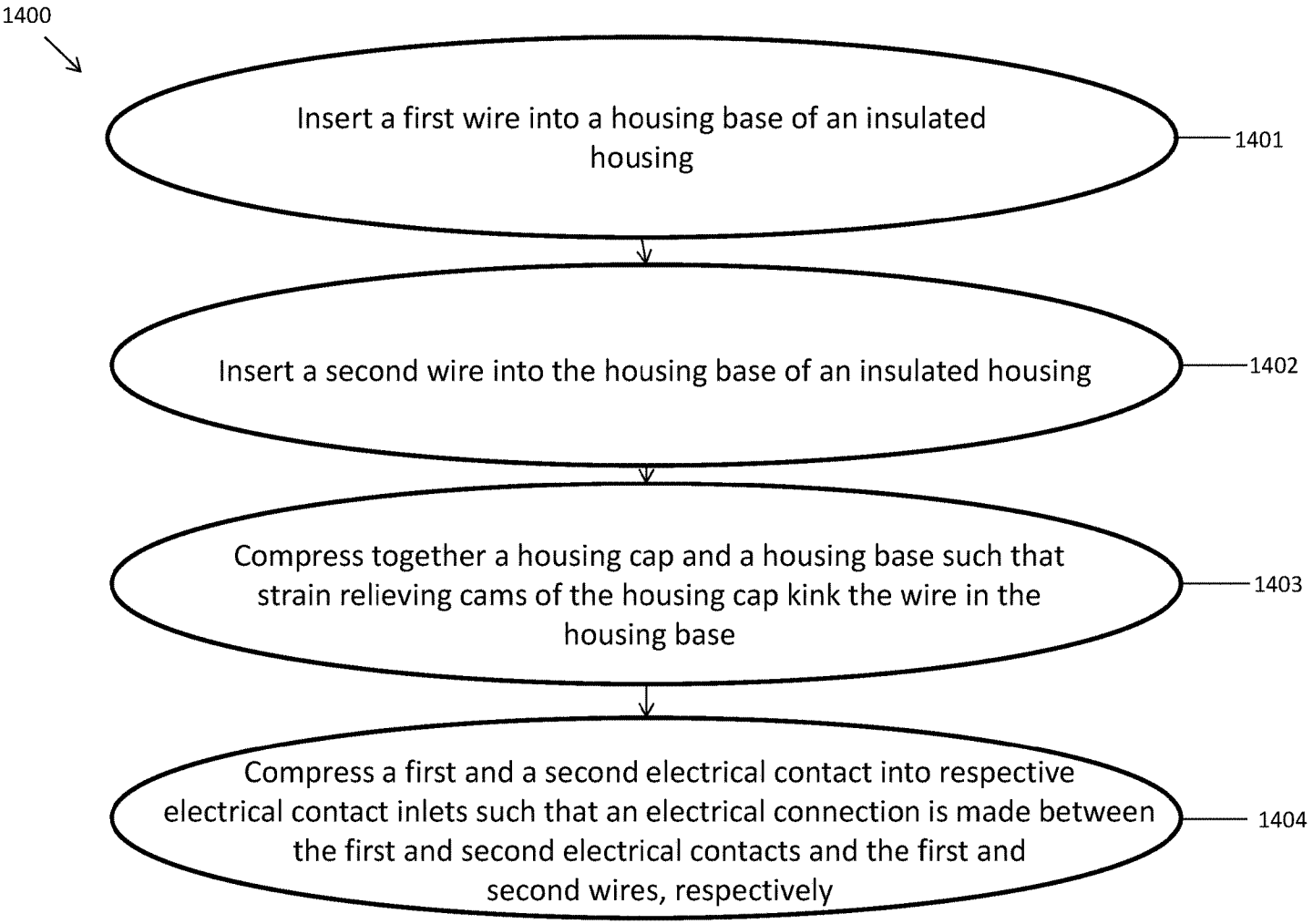
FIG. 14 depicts a third method of use of a wire-to-wire connector in accordance with an illustrative embodiment.

FIG. 14 depicts a third method 1400 of use of a wire-to-wire connector in accordance with an illustrative embodiment. In an operation 1401, a first wire is inserted into a first wire opening of a housing base of an insulated housing. In an operation 1402, a second wire is inserted into a second wire opening of a housing base of an insulated housing. In an embodiment, the first and second wires may extend entirely through the housing base of the insulated housing. In alternative embodiments, the wires may not extend entirely through the housing base. That is, the first and second wires may have only one end protruding from the insulated housing. The first and second wires may be inserted into a housing base of an insulator before electrical contacts are partially inserted into respective electrical contact inlets. Alternatively, the first and second wires may be inserted into a housing base of an insulator after electrical contacts are partially inserted into respective electrical contact inlets.

In an operation 1403, an insulation cap is compressed onto the housing base. That is, the housing cap is installed and mechanically secured completely with the housing base. The compression of the housing cap on the housing base allows for strain relieving cams of the housing cap to kink the first and second wires in a cam receiving portion on the housing base. In operation 1404, further compression of the housing cap causes the housing cap to make contact with a first and second electrical contact partially installed on the housing base. That is, after the strain relieving cams have kinked the first and second wires, and then the housing cap makes contact with the first and second electrical contact and compresses the first and second electrical contact completely into respective first and second electrical contact inlets on the housing base. An insulation displacement connector of a first electrical contact displaces the insulation of the first wire and creates an electrical and mechanical connection between the first electrical contact and the conductive core of the first wire. Additionally, an insulation displacement connector of the second electrical contact displaces the insulation of the second wire and creates an electrical and mechanical connection between the second electrical contact and the conductive core of the second wire.

In an embodiment, an electrical shunt may then be inserted into and/or removed from the insulated housing to selectively shunt the first and second the electrical contacts. An electrical shunt may include a male contact prong or multiple contact prongs that are conductively coupled together. Insertion of the electrical shunt electrically and mechanically couples a first contact prong with a first shunt connector portion of the first electrical contact and electrically and mechanically couples a second contact prong with a second shunt connector portion of the second electrical contact. Removal of the male contact prong electrically and mechanically decouples the male contact prongs from respective shunt connector portions of the first electrical contact and the second electrical contacts.

Various additional embodiments of a wire-to-wire connector with an electrical shunt are illustrated throughout FIGS. 15*a* through 20. The wire-to-wire connector disclosed in these figures is configured to connect a conductive core of an insulated wire with an electrical contact that may be mechanically and electrically shunted to a second electrical contact. In an embodiment, the electrical contacts may each connect to one, two, three, or more wires. Furthermore, the insulated housing may house one, two, or more electrical contacts. It should be appreciated that the wire-to-wire connectors disclosed herein are not limited by a maximum number of wire positions, electrical contacts, shunts, or types of connections that couple each component together.

Figure 15B:
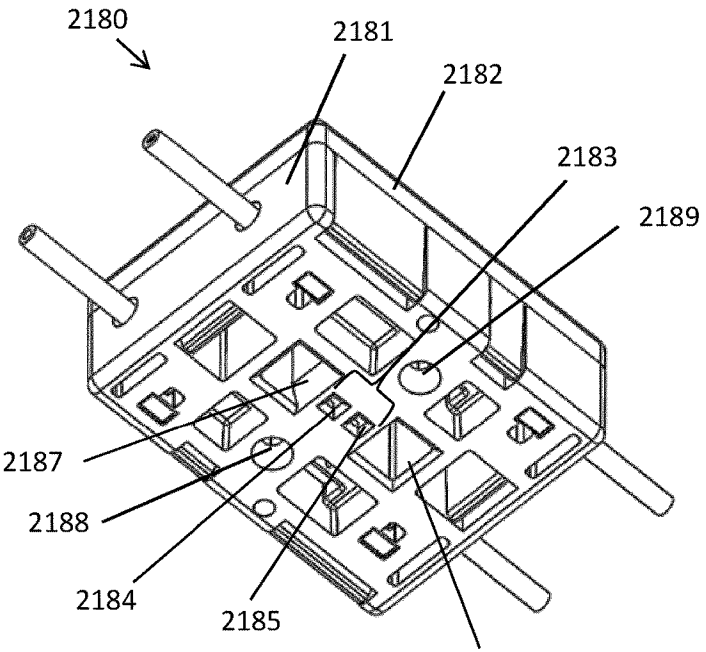
FIG. 15*b* depicts an isometric view of an insulated housing in accordance with an illustrative embodiment.
Figure 15A:
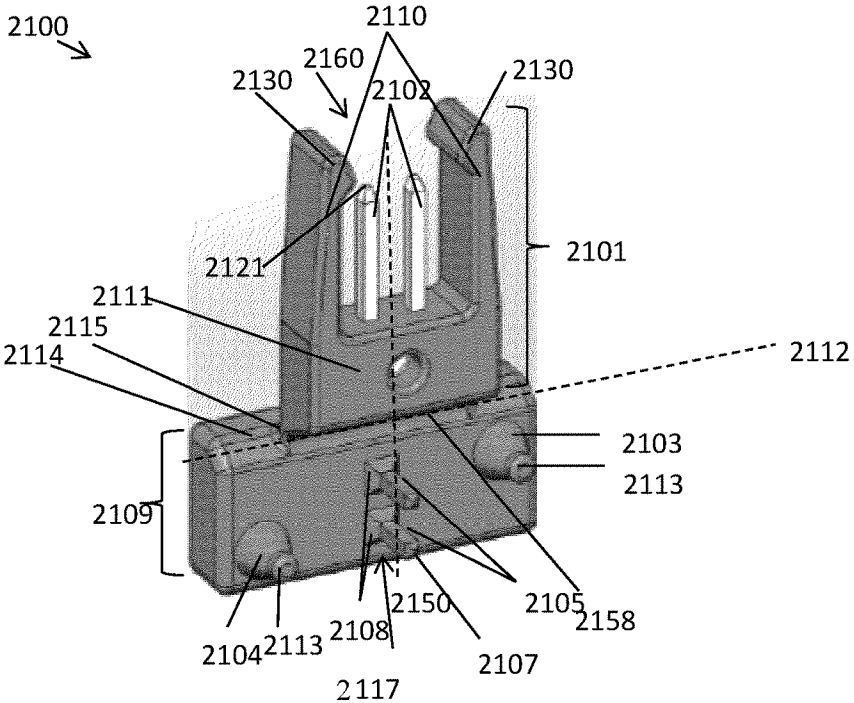
FIG. 15*a* depicts an isometric view of an electrical shunt in accordance with an illustrative embodiment.

FIG. 15*a* depicts an isometric view of an electrical shunt 2100 in accordance with an illustrative embodiment. The electrical shunt 2100 includes a shunt portion 2101 and a cap portion 2109. The shunt portion 2101 includes an electrically-conductive contact portion 2160, a shunt base 2111, and latching prongs 2110. In an embodiment, the electrically-conductive contact portion 2160 includes two male contact prongs 2102. In alternative embodiments, the electrically-conductive contact portion 2160 may include only one or more than two male contact prongs 2102. The two male contact prongs 2102 are configured to interface with a corresponding housing having an insulated material positioned between two electrical contacts that can be selectively shunted together by insertion of the shunt portion 2101. The cap portion 2109 includes an insulated insert portion 2117 configured to selectively engage the one or more electrical contacts. In an embodiment, the insulated insert portion 2117 includes two insulated male tines 2105, a first shunt cap sealing pin 2103, and a second shunt cap sealing pin 2104. In alternative embodiments, the insulated insert portion 2117 may include more or less insulated male tines 2105. In yet other embodiments, the insulated insert portion 2117 may include only one or greater than two shunt cap sealing pins 2103 and 2104.

In an embodiment, the shunt portion 2101 and the cap portion 2109 are connected along an axis 2112. The axis 2112 extends along a first edge 2114 of the cap portion 2109 and a second edge 2115 of the shunt base 2111. In other words, in an embodiment, the cap portion 2109 is offset from the shunt portion 2101 such that the two insulated male tines 2105, the first shunt cap sealing pin 2103, and the second shunt cap sealing pin 2104 all extend parallel to the bottom side of the shunt base 2111. In alternative embodiments, the cap portion 2109 may be rotated relative to the shunt portion 2109 such that the two insulated male tines 2105 and the shunt cap sealing pins 2103 and 2104 extend away from bottom side of the shunt base 2111. The offset of the cap portion 2109 from the shunt portion 2101 protects the two insulated male tines 2105, the first shunt cap sealing pin 2103, and the second shunt cap sealing pin 2104 from damage while the electrical shunt is being handled. In alternative embodiments, the shunt portion 2101 and the cap portion 2109 are connected via a latching mechanism. In another embodiment, the shunt portion 2101 and the cap portion 2109 are connected along one side of the shunt base 2111 and one side of the cap portion 2109 such that the cap portion 2109 and the shunt base 2111 share a side. In an embodiment, the cap portion 2109 is removable from the shunt portion 2101. For example, the cap portion 2109 may be separable from the shunt portion 2101 via a break-away portion 2158 that extends along an axis 2112 and connects the shunt portion 2101 to the cap portion 2109. In alternative embodiments, the cap portion 2109 and the shunt portion 2101 are fixed together such that the cap portion 2109 or the shunt portion 2101 can be selectively engaged with a corresponding housing without separation.

The two male contact prongs 2102 of the shunt portion 2101 are electrically and mechanically connected to one another in the shunt base 2111. The two male contact prongs 2102 are spaced a distance apart that is equal to a distance between the two insulated male tines 2105. In other words, the two male contact prongs 2102 are similarly shaped and spaced apart as the two insulated male tines 2105. In an embodiment, the two insulated male tines 2105 are shorter than the two male contact prongs 2102. In an alternative embodiment, the two insulated male tines 2105 are longer than the two male contact prongs 2102. The two male contact prongs 2102 extend from the shunt base 2111 to a distal end of the two male contact prongs 2102. The two male contact prongs 2102 may include a taper 2121 at the distal end.

The latching prongs 2110 extend from the shunt base 2111 to a distal end of the latching prongs 2110 and are substantially parallel to the two male contact prongs 2102. Knobs 2130 are located at the distal ends of the latching prongs 2110 and extend toward the vertical centerline 2150 of the electrical shunt 2100. The knobs 2130 allow the latching prongs to securely latch onto a corresponding latching portion (e.g., a tapered locking edge of a corresponding insulating housing). In some embodiments, the knobs 2130 may be shaped as half-circles, rectangles, triangles, or any other polygonal shape that allow for the latching prongs 2110 to mechanically secure the electrical shunt 2100 to a corresponding device. The latching prongs 2110 extend a greater distance than the two male contact prongs 2102 from the shunt base 2111. This allows for the electrical shunt 2100 to be efficiently aligned with a corresponding insulated housing. In other words, the latching prongs 2110 will engage with a corresponding latching portion of the insulated housing and the two male contact prongs 2110 may slide into its corresponding opening with minimal adjustment. Furthermore, the two male contact prongs 2102 extend along a first plane from the shunt base 2111 to the furthest extent of the two male contact prongs 2102. The latching prongs 2110 may be centered on the first plane. In alternative embodiments, there may one, two, three, four, five, or more latching prongs 2110.

The two insulated male tines 2105 extend from a base of the cap portion 2109 and terminate at a distal end. As stated above, in alternative embodiments, there may be only one insulated male tine 2105 or there may be more than two insulated male tines 2105. The insulated male tines 2105 are substantially parallel to each other. Each of the two insulated male tines 2105 include a tapered end 2107 at the distal end to allow the two insulated male tines 2105 to be easily inserted into a corresponding opening in an insulated housing and/or electrical contact. Further, each of the two insulated male tines 2105 includes a molded skirt 2108. The molded skirt 2108 extends around a base of the corresponding insulated male tine 2105 and ensures that a corresponding electrical contact is sealed within an opening of the corresponding insulated housing when the cap portion 2109 is fully inserted into the opening of the corresponding insulated housing. In other words, the molded skirt 2108 of each of the two insulated male tines 2105 acts as a sealing gasket between the cap portion 2109 and a corresponding insulated housing. The two insulated male tines 2105 are centered upon the vertical axis 2150. In other embodiments, the two insulated male tines 2105 may be located on any part of the cap portion 2109.

In an embodiment, the first shunt cap sealing pin 2103 and the second shunt cap sealing pin 2104 extend from the body of the cap portion 2109 to respective distal ends. In alternative embodiments, there may be any number of shunt cap sealing pins 2103 and 2104. In yet other embodiments, there may not be any shunt cap sealing pins 2103 and 2104. In an embodiment, the first shunt cap sealing pin 2103 and the second shunt cap sealing pin 2104 each have a conically-shaped base portion. That is, as the first shunt cap sealing pin 2103 and the second shunt cap sealing pin 2104 extend from the body of the cap portion 2109, the first shunt cap sealing pin 2103 and the second shunt cap sealing pin 2104 narrow. In an embodiment, each of the first shunt cap sealing pin 2103 and the second shunt cap sealing pin 2104 many include a lip portion 2113 at a distal end. The lip portion 2113 is generally cylindrically shaped although in other embodiments the shape of the lip portion 2113 may be otherwise modified. In an embodiment, the lip portion 2113 does not narrow as it extends outward from the conically-shaped base portion of either the first shunt cap sealing pin 2103 or the second shunt cap sealing pin 2104. In alternative embodiments, the lip portion 2113 may continue the conical shape of the conically-shaped base portion such that the lip portion 2113 widens as the lip portion 2113 extends outward from the distal end of the base portion of the respective shunt cap sealing pin.

In other embodiments, the lip portion 2113 may be of any shape that ensures a locking between the cap portion 2109 and a corresponding housing. The first shunt cap sealing pin 2103, the second shunt cap sealing pin 2104, and the insulated male tines 2105 all extend from the cap portion 2109 in the same substantially parallel direction. The first shunt cap sealing pin 2103 and a first of the insulated male tines 2105 are centered on and extend along a first plane that is parallel to a second plane along which the second shunt cap sealing pin 2104 and a second one of the insulated male tines 2105 are centered and extend along.

FIG. 15*b* depicts an isometric view of an insulated housing 2180 of a wire-to-wire connector in accordance with an illustrative embodiment. The insulated housing includes a base 2181 and a top 2182. In an embodiment, the base 2181 includes a first latching receptacle 2186, a second latching receptacle 2187, a male-contact-receptacle portion 2183, a first shunt cap sealing pin receptacle 2188, and a second cap sealing pin receptacle 2189. The male-contact-receptacle portion 2183 is a portion of the insulated housing 2180 that exposes a portion of the electrical contacts contained within the insulated housing 2180. Specifically the male-contact-receptacle portion 2183 is a receptacle for male contact prongs that allows the male contact prongs to engage with the electrical contacts. In an embodiment, the male-contact-receptacle portion 2183 includes a first male contact receptacle 2184 and second male contact receptacle 2185. The first and second male contact receptacles 2184 and 2185 have are geometrically shaped to receive corresponding male contact prongs. That is, in alternative embodiments, the first and second male contact receptacles 2184 and 2185 may be square, circular, oval, or any shape that allows for respective male contact prongs to engage with the insulated housing 2180 and thereby the electrical contacts within the insulated housing 2180.

Figures 16A, 16B:
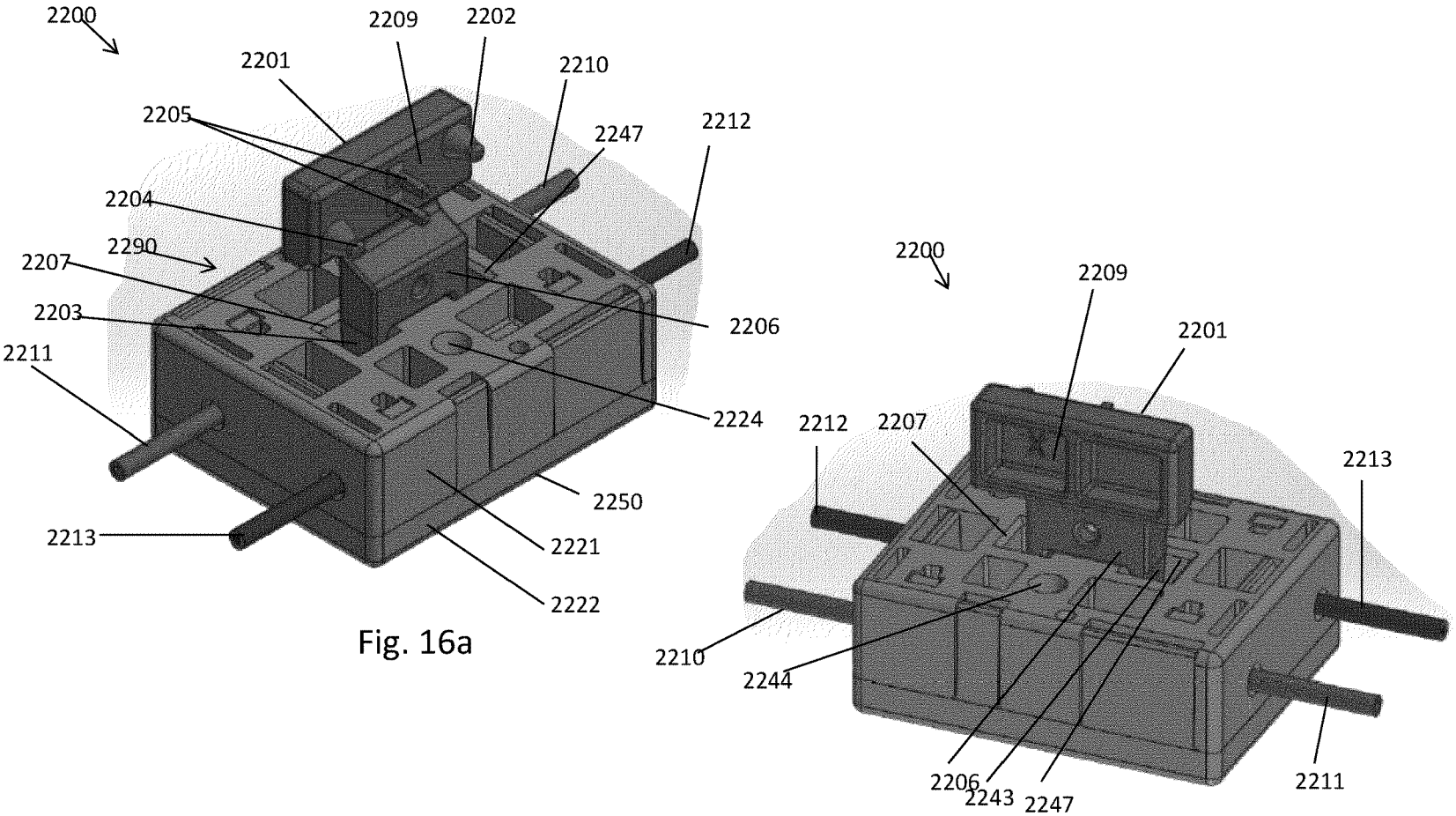
FIG. 16*a* depicts an isometric view of a wire-to-wire connector with wires inserted therein and electrical shunt engaged in accordance with an illustrative embodiment.
FIG. 16*b* depicts a second isometric view of a wire-to-wire connector with wires inserted therein and electrical shunt engaged in accordance with an illustrative embodiment.

FIG. 16*a* depicts an isometric view of a wire-to-wire connector 2200 with wires 2210, 2211, 2212, and 2213 inserted therein and electrical shunt 2201 engaged in accordance with an illustrative embodiment. FIG. 16*b* depicts a second isometric view of the wire-to-wire connector 2200 with wires 2210, 2211, 2212, and 2213 inserted therein and electrical shunt 2201 engaged in accordance with an illustrative embodiment. The wire-to-wire connector 2200 includes an insulated housing 2250, a first electrical contact (not depicted), and a second electrical contact (not depicted). The wires 2210 and 2211 are electrically connected via the first electrical contact (not depicted) located inside an insulated housing 2250. The wires 2212 and 2213 are electrically connected via the second electrical contact (not depicted) located inside the insulated housing 2250. The first electrical contact (not depicted) and the second electrical contact (not depicted) are electrically connected via the electrical shunt 2201.

The insulated housing 2250 includes a base 2221 and a top 2222. The base 2221 includes a male-contact-receptacle portion (not depicted) and a latching portion 2290. In an embodiment, the latching portion 2290 includes a first latching receptacle 2207 and a second latching receptacle 2247. The base further includes a first shunt cap sealing pin receptacle 2224 and a second cap sealing pin receptacle 2244. In alternative embodiments, the latching portion may be more than or fewer receptacles. The electrical shunt 2201 includes a shunt portion 2206 and a cap portion 2209. The shunt portion 2206 includes a first latching prong 2203 and a second latching prong 2243. The first latching prong 2203 is inserted into the first latching receptacle 2207 of the insulated housing 2250 and the second latching prong 2243 is inserted into the second latching receptacle 2247 of the insulated housing 2250. In this way, the electrical shunt 2201 is mechanically secured to the insulated housing 2250.

The cap portion 2209 includes an insulated insert portion 2290. In an embodiment, the insulated insert portion 2290 includes two insulated male tines 2205, a first shunt cap sealing pin 2202, and a second shunt cap sealing pin 2204. The first shunt cap sealing pin 2202 is configured to join with the first shunt cap sealing pin receptacle 2224 and the second shunt cap sealing pin 2204 is configured to join with the second shunt cap sealing pin receptacle 2244. That is, when the electrical shunt 2201 is removed from the insulated housing 2250, the cap portion 2209 may be separated or re-positioned relative to the shunt portion 2206 and the cap portion 2209 may be inserted into the insulated housing 2250 such that the first shunt cap sealing pin 2202 engages the first shunt cap sealing pin receptacle 2224 and the second shunt cap sealing pin 2204 engages the second shunt cap sealing pin receptacle 2244 to seal respective electrical contacts within the insulated housing. For example, the cap portion 2209 may be separable from the shunt portion 2206 via a break-away portion that connects the shunt portion 2206 to the cap portion 2209. In alternative embodiments, the first shunt cap sealing pin 2202 may engage the second shunt cap sealing pin receptacle 2244 and the second shunt cap sealing pin 2204 may engage the first shunt cap sealing pin receptacle 2224. The engagement of the cap portion 2209 to the insulated housing 2250 seals the first and the second electrical contacts within the insulated housing 2250. That is, the geometry of the sealing pins 2202 and 2204 matches the geometry of the shunt cap sealing pin receptacles 2224 and 2244 to prevent incidental ingress of moisture or other debris into the insulated housing. The cap portion 2209 prevents any outside materials from inadvertently contacting the electrical contacts and thereby prevents any possible inadvertent shorting between the electrical contacts.

Figure 17:
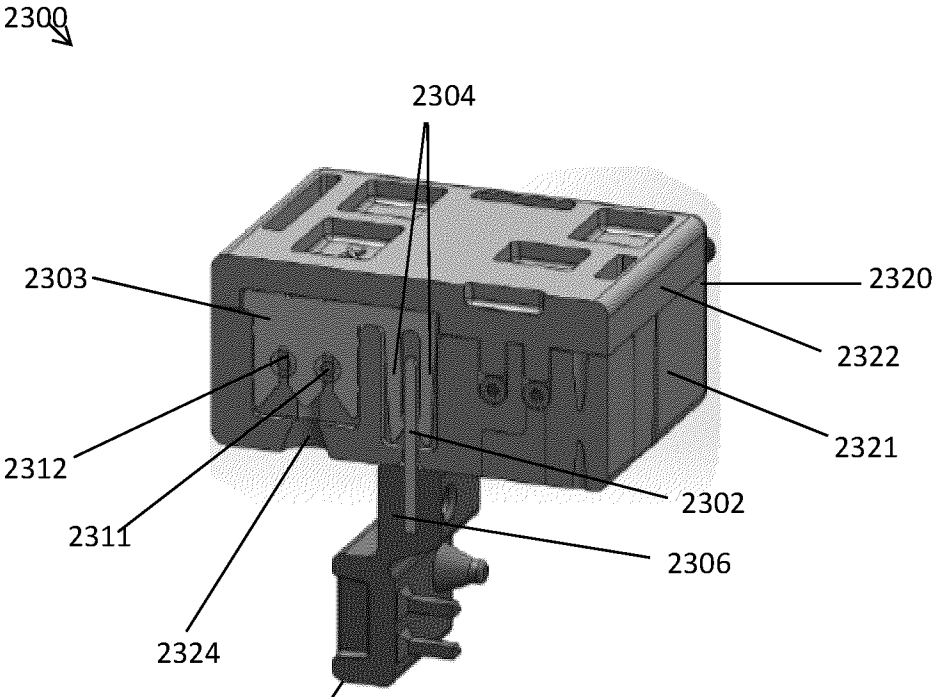
FIG. 17 depicts a first cross-sectional view of a wire-to-wire connector with wires inserted therein and electrical shunt engaged in accordance with an illustrative embodiment.

FIG. 17 depicts a first cross-sectional view of a wire-to-wire connector 2300 with wires 2311 and 2312 inserted therein and electrical shunt 2301 engaged in accordance with an illustrative embodiment. The wire-to-wire connector 2300 includes an insulated housing 2320, a first electrical contact 2303, and a second electrical contact (not visible in FIG. 17). The insulated housing 2320 includes a top 2322 and a base 2321. The wires 2311 and 2312 are electrically and mechanically connected to the first electrical contact 2303 via insulation displacement connectors on the first electrical contact 2303. That is, the wires 2311 and 2312 were inserted into the base 2321, the first electrical contact 2303 was positioned above the wires 2311 and 2312, and the top 2322 was compressed onto the base 2321 causing the insulation displacement connectors (e.g., blades) of the first electrical contact 2303 to displace insulation on the wires 2311 and 2312 and create a mechanical and electrical connection there between. The first electrical contact 2303 and the second electrical contact (not depicted) include contact tines 2304. The contact tines 2304 of the first electrical contact 2303 are compressing a male contact prong 2302 of the shunt portion 2306 of the electrical shunt 2301. That is, there is an electrical and mechanical connection between the male contact prong 2302 and the first electrical contact 2303. In other words, the male contact prong 2302 has a thickness greater than a distance that the contact tines 2304 are apart. The first electrical contact 2303 and the second electrical contact (not depicted) are located in separate recesses of the insulated housing 2320. In other words, there is insulated material entirely between the first electrical contact 2303 and the second electrical contact (not depicted).

Figure 18B:
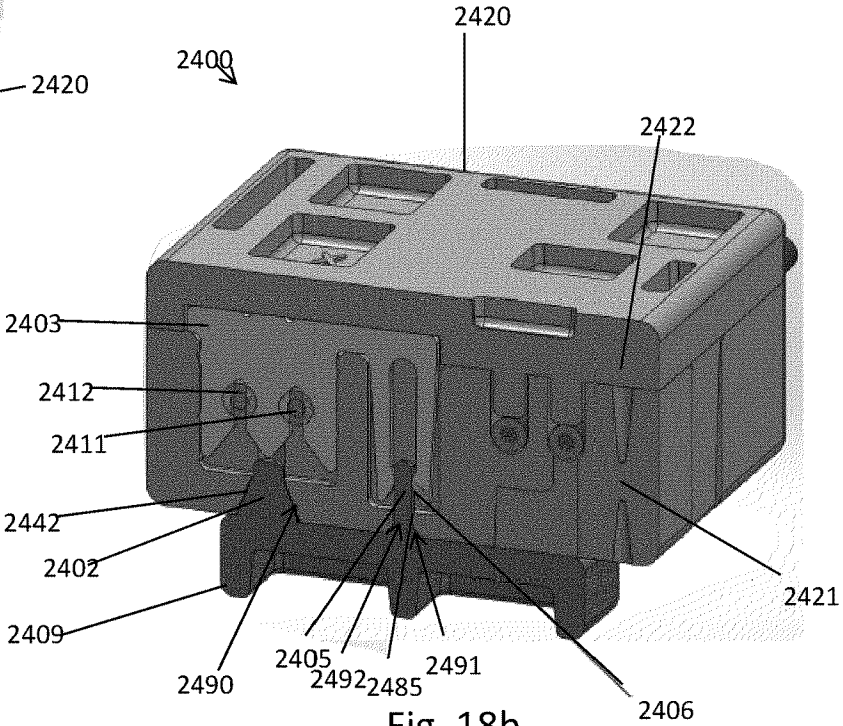
FIG. 18*b* depicts a first cross-sectional view of a wire-to-wire connector with wires inserted therein and shunt cap engaged in accordance with an illustrative embodiment.
Figure 18A:
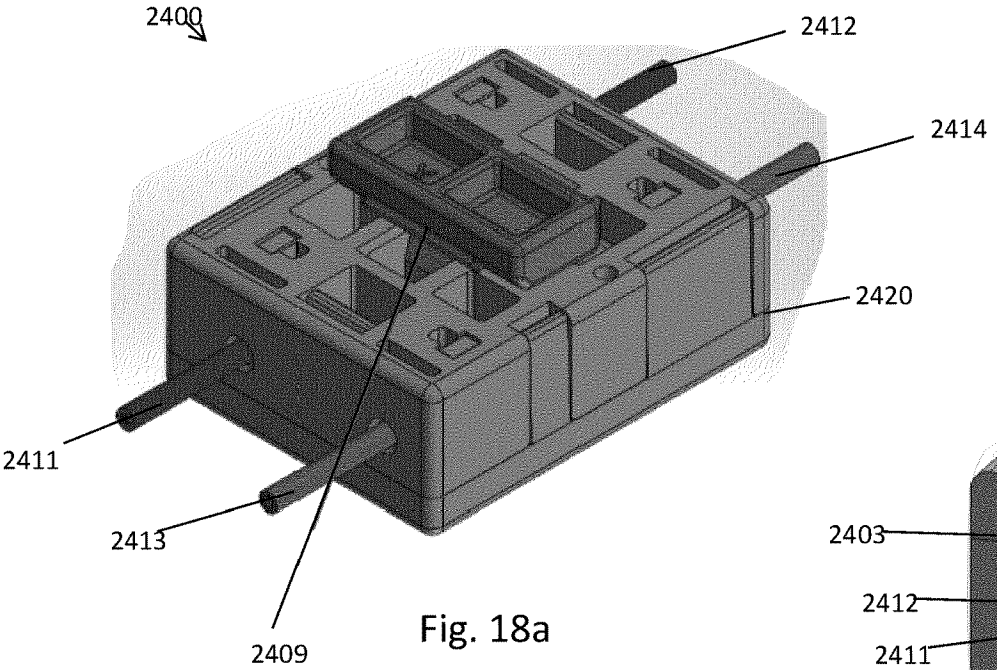
FIG. 18*a* depicts an isometric view of a wire-to-wire connector with wires inserted therein and shunt cap engaged in accordance with an illustrative embodiment.

FIG. 18*a* depicts an isometric view of a wire-to-wire connector 2400 with wires 2411, 2412, 2413, and 2414 inserted therein and cap portion 2409 engaged in accordance with an illustrative embodiment. Referring generally to FIG. 18*a*, the wire-to-wire connector 2400 includes an insulated housing 2420, a first electrical contact (not visible in FIG. 18*a*), and a second electrical contact (not visible in FIG. 18*a*). A cap portion 2409 is inserted into the insulated housing 2420 to seal the first and second electrical contacts (not visible in FIG. 18*a*) within the insulated housing 2420 in order prevent intrusion of external materials or components and to prevent inadvertent shorting that may occur between the first and second electrical contacts (not depicted). Still referring generally to FIG. 18*a*, wires 2411 and 2412 are electrically connected via the first electrical contact (not depicted) and the wires 2413 and 2414 are electrically connected via the second electrical contact (not depicted). The first and second electrical contacts do not have an electrical connection therebetween and are sealed within respective recesses in the insulated housing 2420. In alternative embodiments, the first and second electrical contacts (not depicted) may be connected to more or less wires.

FIG. 18*b* depicts a first cross-sectional view of a wire-to-wire connector 2400 with wires 2411, 2412, 2413, and 2414 inserted therein and cap portion 2409 engaged with insulated housing 2420 in accordance with an illustrative embodiment. The wire-to-wire connector 2400 includes the insulated housing 2420, a first electrical contact 2403, and a second electrical contact (not depicted). The wires 2411 and 2412 are electrically and mechanically connected to the first electrical contact 2403 via the insulation displacement connectors on the first electrical contact 2403. The insulated housing 2420 includes a top 2422 and a base 2421. The base 2421 includes a male-contact-receptacle portion (generally depicted as 2491) and a sealing portion (generally depicted as 2490). In an embodiment, the sealing portion 2490 includes a first shunt cap sealing pin receptacle 2442, and a second shunt cap sealing pin receptacle (not depicted). The cap portion 2409 includes an insulated male insert (generally depicted as 2492). In an embodiment, the insulated male insert 2492 includes a first insulated male tine 2405, a second insulated male contact prong (not depicted), a first shunt cap sealing pin 2402, and a second shunt cap sealing pin (not depicted). The first shunt cap sealing pin 2402 is inserted into the first shunt cap sealing pin receptacle 2442 and the first insulated male tine 2405 is inserted into a corresponding contact tine receptacle 2485 of the male-contact-receptacle portion 2491 and engaged with contact tines 2406 of the first electrical contact 2403 to mechanically secure the cap portion 2409 to the insulated housing 2420 and electrical contact 2403. That is, the first shunt cap sealing pin 2402 is sized and shaped such that, upon engagement with the first shunt cap sealing pin receptacle 2442, the cap portion 2409 and the insulated housing 2420 are mechanically secured together. Additionally, the contact tines 2406 compress the first insulated male tine 2405 to mechanically secure the cap portion 2409 to the insulated housing 2420 and electrical contact 2403. Moreover, the insertion of the first shunt cap sealing pin 2402 into the first shunt cap sealing pin receptacle 2442 and the first shunt cap sealing pin 2402 into contact tines 2406 seals the first electrical contact 2403 within the insulated housing 2420. In other words, the full engagement of the cap portion 2409 and the insulated housing 2420 protects the electrical contact 2403 from the outside environment. Although not depicted, the second electrical contact, the second insulated male tine, the second shunt cap sealing pin, and respective receptacles of the insulated housing act similarly when the cap portion 2409 and the insulated housing 2420 are compressed together. For example, the second insulated male tine engages a second contact tine receptacle of the insulated housing and further engages with contact tines of the second electrical contact. The contact tines of the second electrical contact compress the second insulated male tine and mechanically secures the cap portion 2409 to the insulated housing. In this way, the second male tine seals the second electrical contact within the insulated housing.

Figure 19:
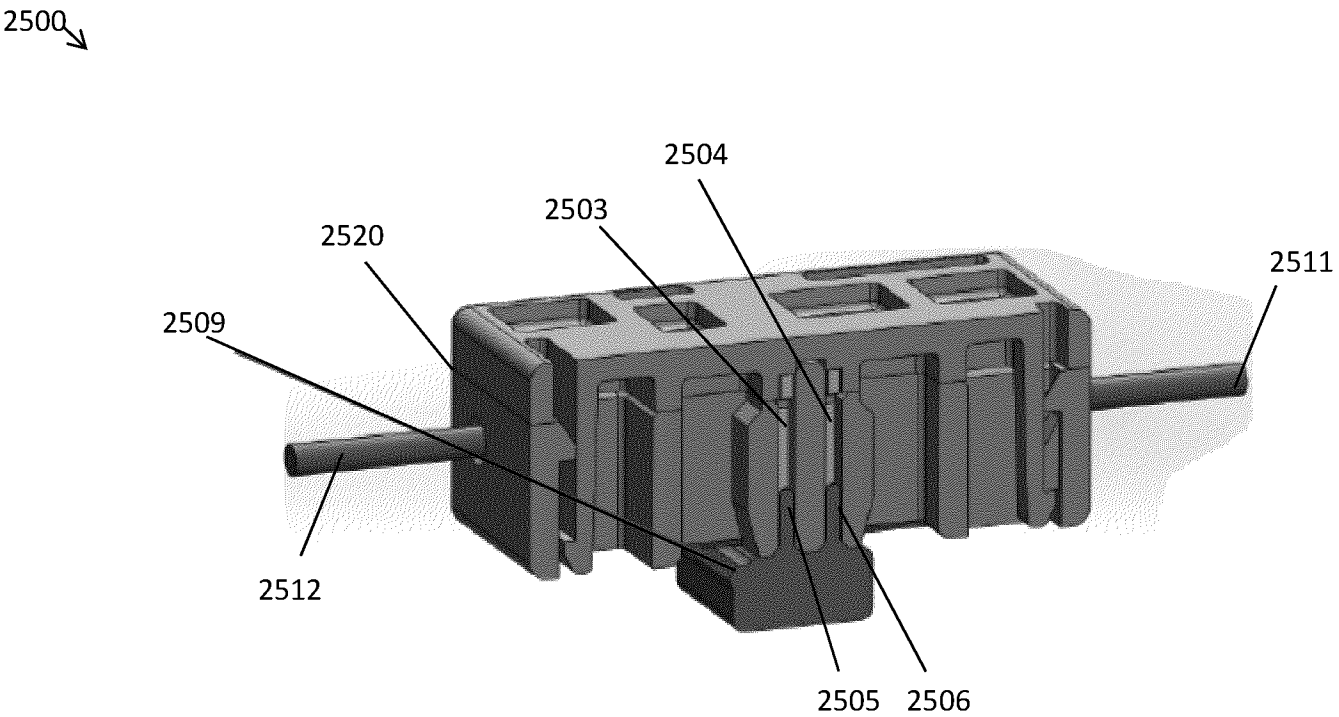
FIG. 19 depicts a second cross-sectional view of a wire-to-wire connector with wires inserted therein and shunt cap engaged in accordance with an illustrative embodiment.

FIG. 19 depicts a second cross-sectional view of a wire-to-wire connector 2500 with wires 2511 and 2512 inserted therein and cap portion 2509 engaged in accordance with an illustrative embodiment. The cap portion 2509 includes an insulated male insert portion. In an embodiment, the insulated male insert portion includes a first insulated male tine 2505, a second insulated male tine 2506 and two shunt cap sealing pins (not depicted). The wire-to wire connector 2500 includes a first electrical contact 2503, a second electrical contact 2504, and an insulated housing 2520. The first insulated male tine 2505 is compressed by the contact tines of the first electrical contact 2503, and the second insulated male tine 2506 is compressed by the contact tines of the second electrical contact 2504. The compression by the contact tines of the electrical contacts on the respective male tine is caused because the thickness of the male contact prong is greater than the distance that the contact tines are spaced apart. Further, the compression by the contact tines on the respective male contact prong causes the cap portion 2509 and the insulated housing 2520 to be mechanically secured together. In alternative embodiments, the cap portion 2509 and insulated housing 2520 may be sealed together using other types of latching devices, adhesive materials, and/or other means.

Figure 20:
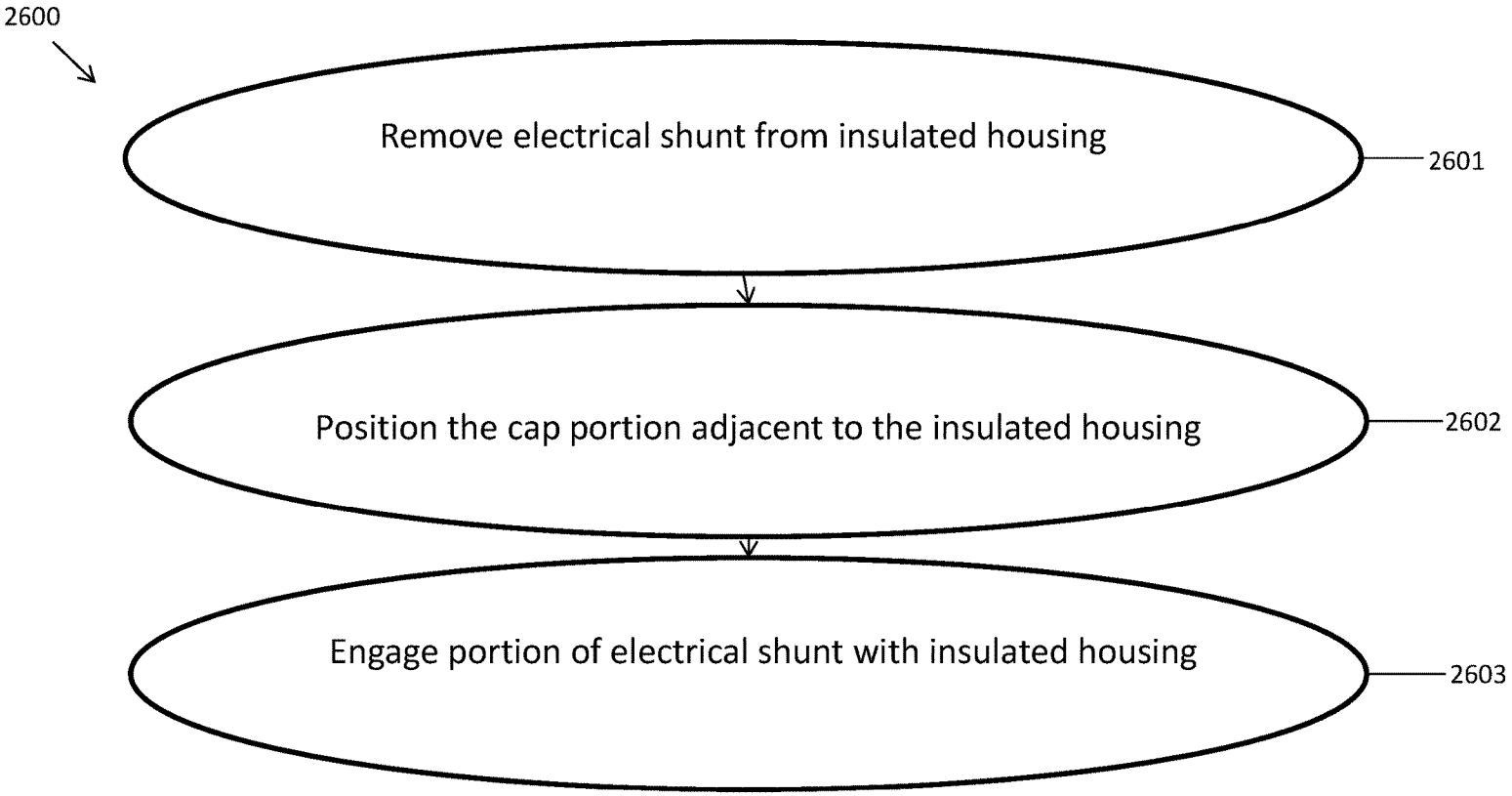
FIG. 20 depicts a flow diagram for a method of use of a wire-to-wire connector with an electrical shunt in accordance with an illustrative embodiment.

FIG. 20 depicts a flow diagram for a method 2600 of use of a wire-to-wire connector in accordance with an illustrative embodiment. In an operation 2601, an electrical shunt is removed from an insulated housing. The removal of the electrical shunt electrically disconnects a first electrical contact from a second electrical contact. Further, the first and second electrical contacts may be electrically and mechanically connected to respective wires. Removal of the electrical shunt electrically disconnects the first electrical contact (and the wires attached and electrically connected thereto) from the second electrical contact (and the wires attached and electrically connected thereto).

In an operation 2602, cap portion is then placed adjacent to the insulated housing such that an insulated male insert portion is aligned with respective receptacles on the insulated housing. In an embodiment, the cap portion is first removed from the shunt portion of the electrical shunt. In alternative embodiments, the cap portion is re-positioned relative to the shunt portion to allow for engagement of the cap portion and the insulated housing. The respective receptacles are the receptacles (e.g., recesses) that expose the electrical contact to the surrounding environment.

In an operation 2603, the cap portion is engaged with the insulated housing. In an embodiment, portions of the cap portion are compressed into the insulated housing. For example, the insulated male contact prongs and the shunt cap sealing pins are compressed into respective receptacles within the insulated housing. The compression seals the respective receptacles, causing the first electrical contact and the second electrical contact to become sealed within the insulated housing. In other words, the insulated male contact prongs and the shunt cap sealing pins are sized and shaped similarly to each respective receptacle such that compression and or close engage of the insulated male contact prongs and the shunt cap sealing pins with the corresponding receptacles causes a seal between those elements.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An apparatus comprising:

a first electrical contact comprising a first insulation displacement connector portion and a first shunt connector portion;

a second electrical contact comprising a second insulation displacement connector portion and a second shunt connector portion; and an insulated housing comprising a first electrical contact inlet, a second electrical contact inlet, a shunt opening, a first wire opening, and a second wire opening;

wherein the first electrical contact inlet is configured to receive the first electrical contact and the second electrical contact inlet is configured to receive the second electrical contact.

2. The apparatus of claim 1, wherein the insulated housing further comprises a housing base comprising a plurality of cam receiving portions and a housing cap comprising a plurality of strain relieving cams.

3. The apparatus of claim 1, wherein the first wire opening and the second wire opening a distance past one of the first or second electrical contacts but not entirely through the housing.

4. The apparatus of claim 1, wherein the first contact inlet extends into the insulated housing along a first plane, the second contact inlet extends into the insulated housing along a second plane, and the shunt opening extends into the insulated housing along a third plane; wherein the first plane is parallel to the second plane; and wherein the third plane is perpendicular to the first and the second planes.

5. The apparatus of claim 1, wherein a depth of the first electrical contact inlet is greater than or equal to a height of the first electrical contact.

6. The apparatus of claim 1, wherein the first electrical contact inlet and the second contact inlet are located on a first side of the insulated housing, and wherein the shunt opening is located on a second side of the insulated housing that is opposite the first side.

7. The apparatus of claim 1, wherein the first electrical contact and the second electrical contact further comprise juts configured to engage an inner surface of the insulated housing.

8. The apparatus of claim 1, wherein each of the insulation displacement connector portions of the first and second electrical contacts comprises a first blade, a second blade, and a third blade, wherein the first blade, the second blade, and the third blade each have a tapered distal end, wherein a distance between the first blade and the second blade is consistent between a base portion of the respective insulation displacement connector portion and the tapered distal ends, and wherein a distance between the second blade and the third blade is consistent between the base portion of the respective insulation displacement connector portion and the tapered distal ends.

9. The apparatus of claim 1, wherein blades of the first insulation displacement connector portion extend from a first base to a furthest extent of the blades along a first plane, wherein first female contact tines of the first shunt connector portion extend from the base to a furthest extent of the female contact tines along the first plane;

wherein blades of the second insulation displacement connector portion extend from the base to a furthest extent of the blades along a second plane, wherein second female contact tines of the second shunt connector portion extend from a second base to the furthest extent of the second female contact tines along the second plane; and wherein the first plane is parallel to the second plane.

10. The apparatus of claim 1, further comprising an electrical shunt, wherein the electrical shunt comprises a male contact prong configured to be received within the shunt opening.

11. The apparatus of claim 10, wherein a distal end of the male contact prong comprises a tapered edge.

12. The apparatus of claim 10, wherein the insulated housing further comprises:

a shunt latching portion comprising two rails spaced a first distance apart on a first side of the insulated housing;

two rails spaced a second distance apart on a second side of the insulated housing;

a first tapered locking edge positioned between the two rails spaced the first distance apart on the first side of the insulated housing; and a second tapered locking edge positioned between the two rails spaced the second distance apart on the second side of the insulated housing;

wherein the electrical shunt further comprises at least two latching prongs comprising a knob at a distal end of each latching prong that extends toward a vertical centerline; and wherein the two latching prongs are spaced a distance apart such that the two latching prongs compress the insulated housing and the knobs rest on tapered locking edge when the electrical shunt is engaged with the insulated housing.

13. The apparatus of claim 10, wherein the first shunt connector portion and the second shunt connector portion each comprise respective female contact sockets, and wherein each of the respective female contact sockets is configured to receive and form an electrically-conductive connection with the male contact prong.

14. The apparatus of claim 13, wherein the female contact socket of the first electrical contact is aligned with the female contact socket of the second electrical contact when received in the insulated housing.

15. The apparatus of claim 13, wherein the female contact socket of the first electrical contact and the female contact socket of the second electrical contact each further comprise two contact tines, and wherein each of the two contact tines comprises a knob at their distal end that extends toward the other of the two contact tines.

16. The apparatus of claim 15, wherein a thickness of the male contact prong is greater than a distance between the two contact tines.

17. A method of connecting a first and a second wire comprising:

inserting a first wire into a first wire opening of an insulated housing;

compressing a first electrical contact into a first electrical contact inlet such that the first electrical contact displaces insulation on the first wire to create an electrical connection between the first electrical contact and the first wire, and wherein the first electrical contact includes a first shunt connector portion;

inserting a second wire into a second wire opening of the insulated housing;

compressing a second electrical contact into a second electrical contact inlet such that the second electrical contact displaces insulation on the second wire to create an electrical connection between the second electrical contact and the second wire, and wherein the second electrical contact includes a second shunt connector portion; and inserting a male contact prong into a shunt opening of the insulated housing such that the male contact prong engages the first shunt connector portion of the first electrical connector and the second shunt connector portion of the second electrical connector to conductively couple the first electrical contact to the second electrical contact.

18. The method of claim 17, wherein inserting the male contact prong into the shunt opening comprises compressing the male contact prong between contact tines of a first female contact socket of the first electrical contact and contact tines of a second female contact socket of the second electrical contact.

19. The method of claim 17, wherein the male contact prong protrudes from an electrical shunt; and wherein the method further comprises securing the male contact prong within the shunt opening via engagement of two latching prongs on the electrical shunt with a latching portion on the insulated housing.

20. A method comprising:

inserting a first wire into a first wire opening of an insulated housing;

compressing a first electrical contact into a first electrical contact inlet such that the first electrical contact displaces insulation on the first wire to create an electrical connection between the first electrical contact and the first wire, and wherein the first electrical contact includes a first shunt connector portion;

inserting a second wire into a second wire opening of the insulated housing;

compressing a second electrical contact into a second electrical contact inlet such that the second electrical contact displaces insulation on the second wire to create an electrical connection between the second electrical contact and the second wire, and wherein the second electrical contact includes a second shunt connector portion; and removing a male contact prong from a shunt opening of the insulated housing such that the male contact prong disengages the first shunt connector portion of the first electrical connector and the second shunt connector portion of the second electrical connector to conductively decouple the first electrical contact from the second electrical contact.

* * * * *